US008429870B2

(12) United States Patent
Chen et al.

(10) Patent No.: US 8,429,870 B2
(45) Date of Patent: Apr. 30, 2013

(54) CONNECTING SYSTEM FOR SURFACE COVERINGS

(75) Inventors: Hao A. Chen, Salem, NJ (US); John M. Whispell, Salem, NJ (US)

(73) Assignee: Mannington Mills, Inc., Salem, NJ (US)

( * ) Notice: Subject to any disclaimer, the term of this patent is extended or adjusted under 35 U.S.C. 154(b) by 0 days.

(21) Appl. No.: 12/956,317

(22) Filed: Nov. 30, 2010

(65) Prior Publication Data

US 2011/0131916 A1 Jun. 9, 2011

Related U.S. Application Data

(60) Provisional application No. 61/266,534, filed on Dec. 4, 2009.

(51) Int. Cl.
*E04B 1/38* (2006.01)

(52) U.S. Cl.
USPC ..... 52/582.1; 52/592.1; 52/589.1

(58) Field of Classification Search ..... 52/843, 52/844, 539, 588.1, 589.1, 582.1, 591.1, 52/592.1, 592.4, 586.1, 586.2, 384, 471, 52/747.11, 483.1, 177, 745.21, 585.1, 578, 52/581, 582.2, 592.3, 372, 461, 464, 468, 52/730.6, 731.7, 506.1, 506.05, 506.06, 506.07, 52/506.08, 506.09, 391; 403/286, 292, 294
See application file for complete search history.

(56) References Cited

U.S. PATENT DOCUMENTS 1,764,331 A 6/1930 Moratz
1,808,591 A 6/1931 Bruce
2,004,193 A 6/1935 Cherry
2,152,694 A 4/1939 Hoover
2,852,815 A 9/1958 Sale
2,882,560 A 4/1959 Plendl
3,200,553 A 8/1965 Frashour et al.
3,437,360 A 4/1969 Gould et al.
3,623,288 A 11/1971 Horowitz
3,731,445 A 5/1973 Hoffmann et al.
4,095,913 A 6/1978 Pettersson et al.
4,426,820 A 1/1984 Terbrack et al.
4,471,012 A 9/1984 Maxwell
4,695,502 A 9/1987 Rush
4,807,416 A 2/1989 Parasin
4,953,335 A 9/1990 Kawaguchi et al.
5,283,702 A 2/1994 Tsuyuguchi et al.
5,295,341 A 3/1994 Kajiwara
5,348,778 A 9/1994 Knipp et al.
5,437,934 A 8/1995 Witt et al.
5,618,602 A 4/1997 Nelson
5,694,730 A 12/1997 Del Rincon et al.
5,706,621 A 1/1998 Pervan
5,736,227 A 4/1998 Sweet et al.
5,797,237 A 8/1998 Finkell, Jr.
(Continued)

*Primary Examiner* — Brian Glessner
*Assistant Examiner* — Beth Stephan
(74) *Attorney, Agent, or Firm* — Kilyk & Bowersox, P.L.L.C.

(57) ABSTRACT

A plank, and system and method for joining surface-covering planks, which includes a disengageable connector(s) for detachably connecting multiple planks simultaneously are described. A plank can include a tongue-profiled edge and an opposite rib-profiled edge, and a disengageable connector can have a groove that can be mated with the tongue on one side edge of the plank, and also has a rib-receiving portion that alternatively can be mated with a downward extending rib on the opposite side edge of the plank. The plank can have a variety of designs on the other edges of the plank.

38 Claims, 12 Drawing Sheets

U.S. PATENT DOCUMENTS

| | | | | |
|---|---|---|---|---|
| 5,860,267 | A | 1/1999 | Pervan | |
| 6,006,486 | A | 12/1999 | Moriau et al. | |
| 6,023,907 | A | 2/2000 | Pervan | |
| 6,094,882 | A | 8/2000 | Pervan | |
| 6,101,778 | A | 8/2000 | Martensson | |
| 6,182,410 | B1 | 2/2001 | Pervan | |
| 6,205,639 | B1 | 3/2001 | Pervan | |
| 6,363,677 | B1 * | 4/2002 | Chen et al. | 52/586.1 |
| 6,449,918 | B1 * | 9/2002 | Nelson | 52/582.1 |
| 6,591,568 | B1 * | 7/2003 | Palsson | 52/592.2 |
| 6,617,009 | B1 | 9/2003 | Chen et al. | |
| 6,675,545 | B2 * | 1/2004 | Chen et al. | 52/586.1 |
| 6,763,643 | B1 * | 7/2004 | Martensson | 52/586.1 |
| 6,769,217 | B2 * | 8/2004 | Nelson | 52/582.1 |
| 6,874,292 | B2 | 4/2005 | Moriau et al. | |
| 7,051,486 | B2 | 5/2006 | Pervan | |
| 7,127,860 | B2 * | 10/2006 | Pervan et al. | 52/592.1 |
| 7,614,197 | B2 * | 11/2009 | Nelson | 52/582.1 |
| 2001/0021431 | A1 | 9/2001 | Chen et al. | |
| 2002/0031646 | A1 | 3/2002 | Chen et al. | |
| 2007/0022694 | A1 | 2/2007 | Chen et al. | |
| 2007/0062148 | A1 * | 3/2007 | Nienhuis et al. | 52/592.1 |

* cited by examiner

CONNECTING SYSTEM FOR SURFACE COVERINGS

This application claims the benefit under 35 U.S.C. §119 (e) of prior U.S. Provisional Patent Application No. 61/266,534, filed Dec. 4, 2009, which is incorporated in its entirety by reference herein.

BACKGROUND OF THE INVENTION

The present invention relates to surface-coverings, like flooring, and methods of installing the same.

Laminate flooring usually has at least a core of particle or fiberboard or other wood-type material, an upper decorative surface layer, and a lower balancing layer of polymer or paper, or like material. The surface layer provides appearance and durability to the floorboards. The core provides stability, and the balancing layer keeps the board plane when the relative humidity (RH) varies. The floorboards are generally laid floating, i.e., without gluing, on an existing subfloor. Conventional floating flooring of this type are usually joined by means of a tongue-and-groove joints (i.e., joints involving a tongue on one floorboard and a tongue groove on an adjoining floorboard) on the long side and the short side that are mechanically locked in place. When laying the floor, the boards are brought together horizontally, whereby a projecting tongue along the joint edge of one board is introduced into a groove along the joint edge of an adjoining board. The same method is used on the long side as well as on the short side. Various types of glueless mechanical locking systems (including straight tongue and groove arrangements) have been utilized in the flooring industry. Flooring with glueless mechanical locking systems (tongue and groove arrangements) are becoming increasingly popular, as they are easy to lay, and, thus, it is not necessary to utilize highly trained personnel to lay such floor tiles.

An advantage of floating floors with mechanical locking systems is that the floating floors can easily and quickly be laid by various combinations of inward angling and snapping-in. The floating floors can also easily be taken up again and used once more at a different location. A further advantage of the mechanical locking systems is that the edge portions of the floorboards can be made of materials which need not have good gluing properties. The most common core material is a fiberboard with high density and good stability, such as HDF—High Density Fiberboard. Sometimes also MDF—Medium Density Fiberboard—is used as the core.

Current floor systems have suffered, however, from disadvantages. One disadvantage experienced with current floor systems is that if each of the side edges of a plank includes a mechanical locking tongue or groove, once one of the side edges is connected to another similar plank, it is difficult to connect the other side edges of the plank with yet another similar plank. Lifting portions of the connected flooring is necessary to create a proper angle to connect the plank. This problem particularly accentuates itself while installing a click system floor in a very limited-free-space and/or confined area such as in corners of a room, under or around a door jamb, or under or around closets or kitchen islands, and the like. In these areas there is no room for lifting portions of the connected flooring to create the necessary angle to connect the plank.

In addition, the groove edge design of many conventional planks having a wood or wood-based core require the edge portions of the plank to be cut very thin. The thin edge portions of these planks render the planks more vulnerable to damage during shipping and handling. Once the edge of the plank is damaged, the plank cannot be effectively attached to other planks and is thereby rendered useless.

Also, certain groove edge designs are difficult to machine on wood or wood based materials. Oftentimes, it is difficult to precisely shape a groove profile for wood or wood-based materials in a production line. Thus, there are a limited number of groove designs which are available and effective for the edges of wood or wood-based planks.

Some current flooring systems have a mechanical locking tongue and groove on the first opposing side edges and a straight edge on the other opposing side edges. This type of flooring system, however, also includes certain disadvantages. For example, the straight side edges that are connected to one another may not be water tight and could potentially slide open to form a gap. If an adhesive is used, the adhesive can be pressed out of the seams and create messy seams.

Other flooring systems have flexible grooves that have some "give" to permit connecting without angling. The integrity of such systems, however, is questionable and there is difficulty in making such a joint.

Accordingly, there is a need to provide a connecting system for flooring and other surface-coverings, which is relatively inexpensive, provides an excellent connection between the planks, is easy to connect along each of the side edges of the planks, and/or is moisture resistant and provides an overall acceptable bond strength between two joined planks.

SUMMARY OF THE INVENTION

A feature of the present invention is to provide a plank having side edges and a connector configured for making secure and detachable mechanical connection with the different side edges.

Another feature of the present invention is to provide a plank having side edges that incorporate different mechanical interlock features and a connector configured for making secure and detachable mechanical connection with the different side edges.

Still another feature of the present invention is to provide a plank that can be easily connected to other planks with a disengageable connector.

Another feature of the present invention is to provide a plurality of planks detachably joined together in a drift-resistant configuration with enhanced pullout strength.

Still another feature of the present invention is to provide a surface-covering system which has significant improvements with respect to ease of installation into an assembly of connected planks, which are drift-resistant as assembled but also readily detachable for repair or replacement.

Also, a feature of the present invention is to provide a flooring system that can avoid the use of the application of a wet adhesive composition.

Another feature of the present invention is to provide a flooring system that has great flexibility for assembly into various floor covering shapes and sizes, and which can be installed at confined areas.

Also, a feature of the present invention is to provide a flooring system that includes a foolproof installation design and technique to prevent installation errors.

Another feature of the present invention is a method for joining together floor planks having opposite edges comprising different mechanical interlocking structures with a detachable connector that is connectible with either edge profile.

Additional features and advantages of the present invention will be set forth in the description which follows, and, in part, will be apparent from the description, or may be learned by practice of the present invention. The features and other advantages of the present invention will be realized and attained by means of the elements and combinations particularly pointed out in the written description and the claims.

To achieve these and other advantages and in accordance with the purposes of the present invention, as embodied and broadly described herein, the present invention, in one embodiment, relates to a plank that includes a tongue-profiled edge and an opposite rib-profiled edge, and a disengageable connector that can be detachably connected at either of these profiled edges of the plank. The disengageable connector has a groove that can be mated with a tongue on one side edge of the plank, and also has a rib-receiving portion that alternatively can be mated with a downward extending rib on the opposite side edge of the plank. The plank also can have a variety of designs on the other edges of the plank.

The present invention further relates to a plank comprising a first edge having an cantilevered tongue and a first recess at a backside of the tongue, an opposite second edge having a downwardly extending rib and adjacent a second recess, and a connector that is detachably engageable to either of these edges. The connector has a groove configured to receive the cantilevered tongue of the first edge, and a rib-receiving portion configured to receive the rib of the second edge of the plank. Additionally, the connector can comprise a first arm, a second arm and a third arm, which interlock with edge features of the plank. The first arm is receivable by the second recess of the second edge of a plank. The second arm is receivable by the first recess of the first edge of a plank, and the second and third arms define the tongue-receiving groove. The plank also can include opposite third and fourth edges having profiled edges or straight edges, as additional plank mating edges. Also, the plank can comprise a panel member having a generally planar top wear surface and a bottom surface for contact with a support structure. In addition, the first, second, third, and fourth edges can be defined in respective side edges extending between the top and bottom surfaces.

The present teachings further relate to a plurality of planks connected together along adjacent side edges by a detachable intermediate connector to form a surface-covering system. The planks comprise a first edge having a tongue and an adjacent first recess and an opposite second edge comprising a downwardly extending rib and an adjacent second recess. The planks also can comprise opposite third and fourth edges comprising a profiled or straight edges. The connector attaches a first edge of a first plank to a second edge of an adjacent second plank. The connector comprises a groove and a rib-receiving portion. The connector groove receives the tongue of the first edge of the first plank. The connector rib-receiving portion receives the downwardly extending rib of a second edge of an adjacent second plank. Additionally, the connector can further include a first arm that is receivable by the second recess of the second edge of the second plank, a second arm that is receivable by the first recess of the first edge of the first plank, and the second arm and a third arm define the groove that receives the tongue of the first edge. The third arm can further comprise vertical extending and integral horizontal extending portions to both partly define the connector groove and also provide a resting surface for an overlying portion of the second edge of the adjacent second plank. The first and third arms can further comprise standoff latches configured to protrude into the rib-receiving portion to frictionally interfit with the downward extending rib when received in the rib-receiving portion.

The present teachings also relate to floor coverings comprising a plurality of planks connected together in parallel rows along adjacent first and second parallel edges with the connectors. The connectors securely interlock first and second edges of adjacent planks in a drift-resistant manner, but also are conveniently detachable for possible subsequent repair, replacement or disassembly. The disassembled planks and connectors can be re-used in the assembly of new surface-covering patterns or shapes.

The present teachings also relate to a method to connect two or more planks together. The method can involve inserting a downwardly-extending rib of an edge of a first plank into a rib-receiving portion of a connector, and inserting a tongue located along the edge of an adjacent second plank at a slanted angle into a groove of the same connector. The method can further comprise inserting a leading connector arm in a recess defined in the rib-profiled side edge of the first plank in combination with the rib being received by rib-receiving portion of the connector. An overlying portion of the rib-profiled side edge can come to rest on a horizontal-extending portion of an intermediate connector arm, which together with a separate trailing connector arm defines the groove. Rotation of the two planks relative to each other can lock the tongue in place relative to the groove to form a mechanical interlock therewith as the planks are brought into substantially co-planar orientation. The method can further comprise inserting the trailing connector arm in a separate recess defined in the tongue-side edge of the adjacent second plank in combination with the tongue rotating into locked position within the groove.

The present teachings also relate to a plank connector configured to detachably connect with different edge profiles presented on adjacent plank edges.

The present teachings also relate to floor coverings comprising a plurality of planks connected together in parallel rows along adjacent first and second parallel edges with the connectors wherein first and second grooved edges are mechanically connected by a co-extruded barbed spline jointly installed in adjacent grooves defined in adjacent first and second edges.

DETAILED DESCRIPTION OF THE PRESENT INVENTION

Figure 1:
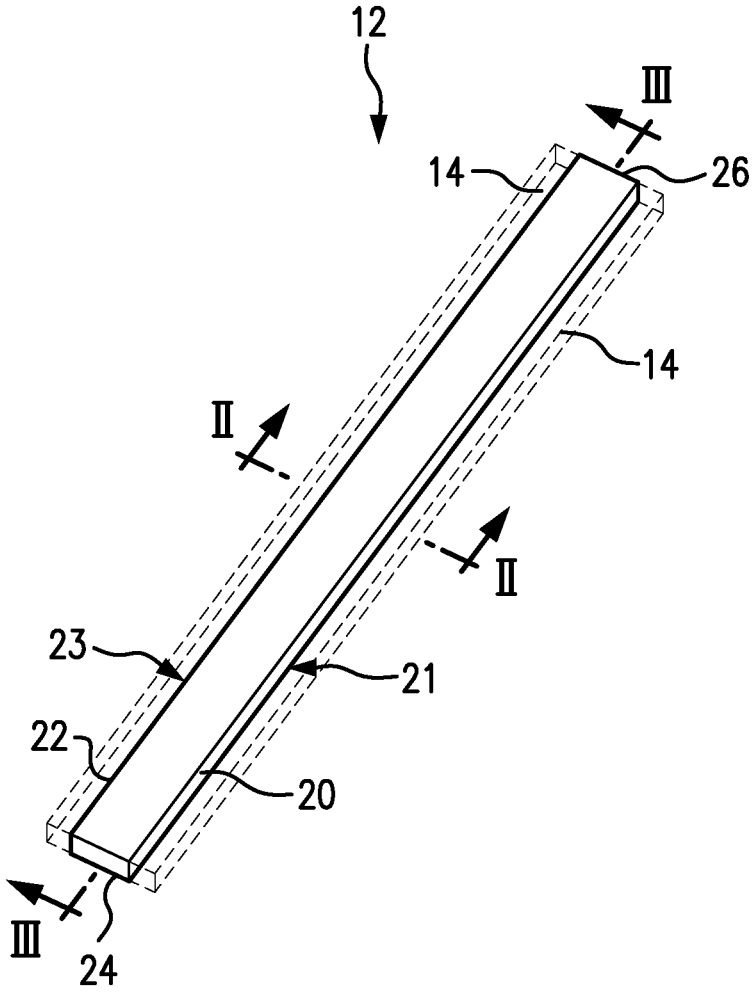
FIG. 1 is a perspective top view of a plank according to various embodiments of the present invention.

In the present invention, it is understood that the various embodiments shown in the Figures are illustrative, and unless indicated otherwise are not necessarily drawn to scale. Further, any dimensions given for various structural features are for illustrative purposes only, and are in no way intended to limit the scope of the present invention.

The present invention relates to a surface covering system having a plank including mechanically mating features defined in opposite edges and a connector configured to provide unique connection systems. The plank can be assembled in a modular detachable manner with other similarly configured planks to provide surface-coverings that are convenient to install and that have enhanced drift-resistance and other beneficial performance.

The plank of the present invention can comprise a plank that includes a tongue profile extending along a first edge of the plank, a downwardly extending rib profile extending along a second edge opposite to the tongue profile, and a disengageable connector for joining the edges of adjacent planks. The tongue profile comprises a tongue that is preferably an integral part of the plank and is preferably not detachable therefrom. The detachable connector can be connected to the second edge of a plank, and includes a groove profile that is capable of receiving the tongue of a similarly configured, adjacent plank. The tongue-profiled first edge, the detachable connector, and the rib-profiled second edge, can have any design or shape as long as the tongue and the rib can be securely connected to the detachable connector.

In further various embodiments, the plank can comprise a panel member defining a generally planar top wear surface, a bottom surface for contact with a support structure, a first pair of edges that are parallel to one another, and a second pair of edges that are parallel to one another, and a disengageable connector that is alternatively attachable to at least one pair of the edges. The pairs of edges can be defined in side edges extending between the top and bottom surfaces of the panel member. The first pair of edges can comprise a leading edge and a trailing edge. The leading edge can comprise a tongue profile. The tongue profile can comprise a tongue and a first recess. The trailing edge can comprise a rib-profiled edge. The rib-profiled edge can comprise a downwardly extending rib and a second recess. The connector can comprise a groove and a rib-receiving portion. The groove can be configured to receive the tongue of the leading edge of the floor plank. The rib-receiving portion can be configured to receive the downwardly extending rib of the trailing edge of another similarly configured plank. A detachable connector is shared by more than one floor plank. For each plank, the first pair of edges can comprise a pair of side edges each having a first length, and the second pair of edges can comprise a pair of end edges each having a second length. The first length can be longer than the second length.

The plank also can include a variety of designs on the other edges of the plank, such as additional mating edges that permit the plank to be assembled with other planks from additional directions. The other edges can have straight edges that can abut, or can define profiled edges that directly connect with each other, or there can be some intermediate connecting system used to join planks at the other edges.

An exemplary plank of various embodiments of the present invention is illustrated in FIG. 1. As shown in FIG. 1, the plank 12 can comprise a first pair of edges, 20 and 22, that are parallel to one another, and a second pair of edges, 24 and 26, that are parallel to one another, and a connector 14 that is detachably connectible at one or more edges (20, 22, 24, 26) is generally outlined by dashed lines. The generalized connector 14 shown in this view can represent a partial exposed portion thereof, as another portion attached to the plank edge may be hidden from top view.

Figure 2:
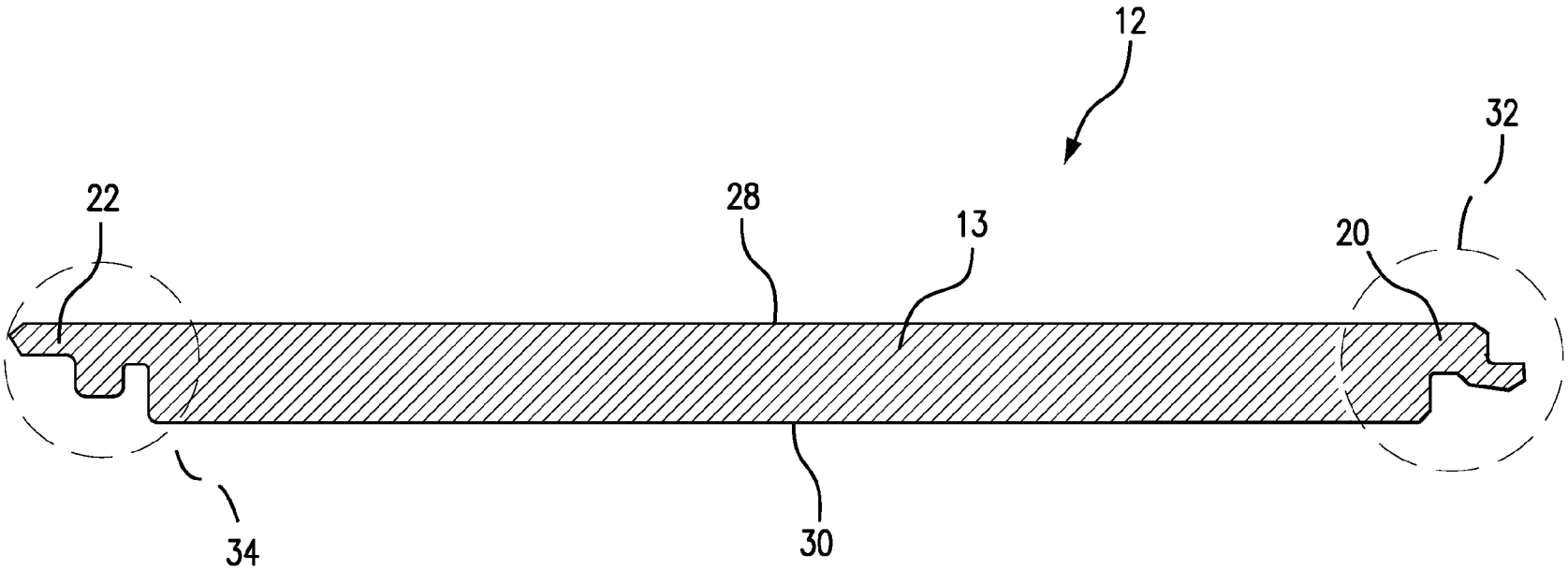
FIG. 2 is a cross-sectional view according to line II-II in FIG. 1.

FIG. 2 depicts a plank 12 according to one exemplary embodiment. The plank 12 can comprise a panel member 13 including a top surface 28 and a bottom surface 30. The first pair of edges, 20 and 22. Edges 20 and 22 also are referred to herein as leading edge 32 and trailing edge 34, respectively, of a plank. Where used, these terms are arbitrary terms used for convenience in describing embodiments of the present teachings, and are not limiting.

Figure 3:
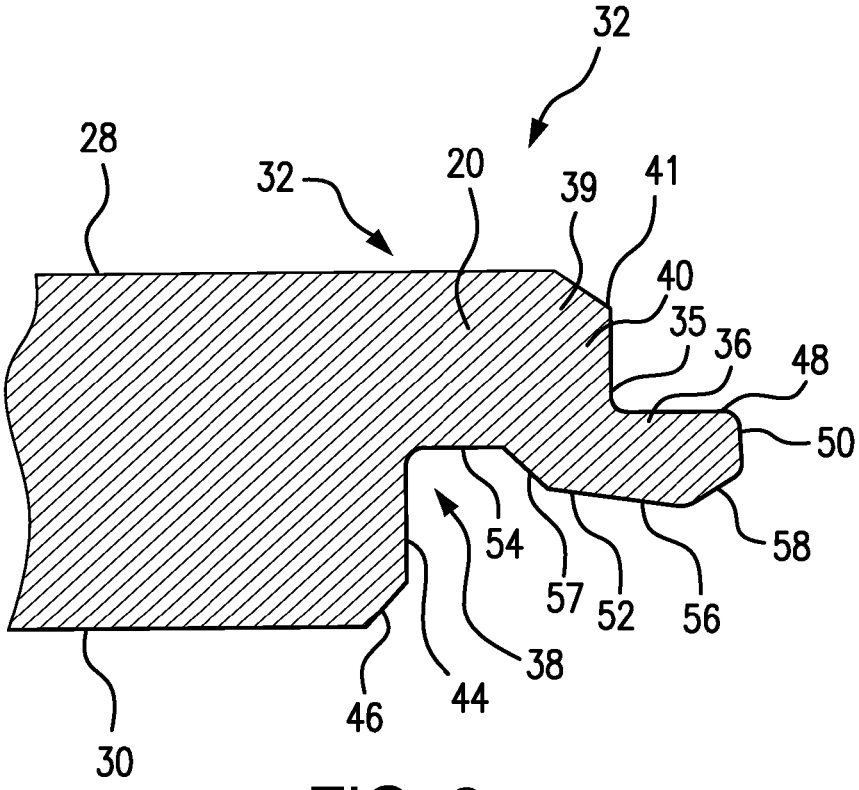
FIG. 3 is an enlarged view of a first edge shown in FIG. 2.

FIG. 3 depicts an exemplary first edge 20 of the plank 12 such as shown in FIG. 2. The first edge 20 can be a tongue profile 35 comprising a tongue 36 and a first recess 38 located at the backside of the tongue 36. As is shown, the tongue profile 35 can comprise an inclined top portion 39 extending from the top surface 28 of the plank 12, a vertical shoulder 40 extending downward from the inclined top portion 39 toward the tongue 36, a vertical distal surface 44 extending downward from the tongue 36, and a slanted distal surface 46 extending from the vertical distal surface 44 to the bottom surface 30 of the plank 12. The inclined top portion 39 and the vertical shoulder 40 can intersect at junction 41. The tongue 36 can have a cantilevered configuration. The tongue 36 can comprise a top planar surface 48, a vertical lip 50 extending downwardly from the top planar surface 48, and an angled bottom surface 52 extending between the vertical lip 50 and the vertical shoulder 44. The angled bottom surface 52 can extend downward from the vertical lip 50. The angled bottom surface 52 of the tongue 36 can comprise an upper portion 54 and a lower portion 56. A first slanted wall 58 can extend diagonally between the vertical lip 50 and the lower portion 56 of the angled bottom surface 52 and a second slanted wall 57 can extend diagonally between the lower portion 56 of the angled bottom surface 52 and the upper portion 54 of the angled bottom surface 52. The inclined top portion 39 of the leading edge 32 and the top surface 28 of the plank 12 can form an angle that is greater than 90 degrees. The inclined top portion 39 and the top surface 28 of the plank 12 can form an angle that is at least 125 degrees. The slanted distal surface 46 and the bottom surface 30 of the plank 12 can form an angle that is greater than 90 degrees. The slanted distal surface 46 and the bottom surface 30 of the plank 12 can form an angle that is at least 125 degrees.

Figure 4:
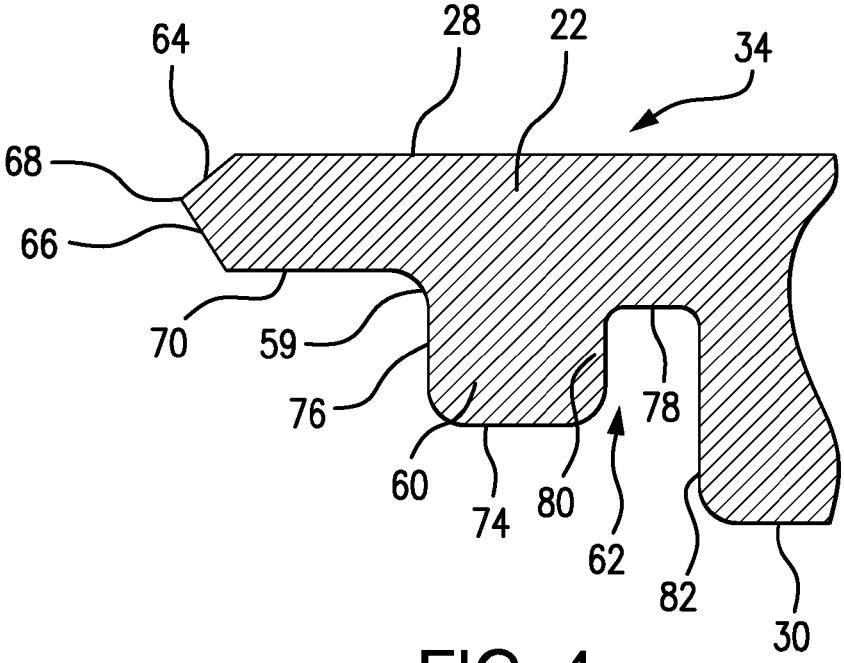
FIG. 4 is an enlarged view of a second edge, opposite to the first edge, shown in FIG. 2.

FIG. 4 depicts an exemplary second edge 22 of the plank 12 such as shown in FIG. 2. The second edge 22 can be a rib profile 59 comprising a downwardly extending rib 60 and a second recess 62. As shown in FIG. 4, the rib profile 59 can comprise a first slanted surface 64 that extends from the top surface 28 of the plank 12 in a first direction and a second slanted surface 66 that extends from the first slanted surface 64 in a second direction. The first direction can be a direction away from the plank 12 and the second direction can be a direction toward the plank 12. The first slanted surface 64 and the second slanted surface 66 connect at joint 68. The first slanted surface 64 can form an angle with the top surface 28 of the plank 12 that is at least 90 degrees. The first slanted surface 64 can form an angle with the top surface 28 of the plank that is at least 125 degrees. The first slanted surface 64 can form an angle with the second slanted surface 66 that is at least 90 degrees. The first slanted surface 64 can form an angle with the second slanted surface 66 that is at least 125 degrees. The trailing edge 34 can comprise a first bottom planar surface 70 connecting to the second slanted surface 66 and extending parallel to the top surface 28 of the plank 12. A second bottom planar surface 74 can be disposed further from the top surface 28 of the plank 12 than the first bottom planar surface 70 and extend parallel to the top surface 28 of the plank 12. A first vertical wall 76 can extend downward from the first bottom planar surface 70 and connect to the second bottom planar surface 74. A second vertical wall 80 can extend between the second bottom planar surface 74 and a third bottom planar surface 78. The third bottom planar surface 78 can be closer to the top surface 28 of the plank 12 than the second bottom planar surface 74. The third bottom planar surface 78 can be further from the joint 68 than the first bottom planar surface 70 and the second bottom planar surface 74. A vertical shoulder 82 can extend from the third bottom planar surface 78 to the bottom surface 30 of the plank 12. The rib 60 can be at least partially defined by the first vertical wall 76, the second planar bottom surface 74, and the second vertical wall 80.

Figure 5:
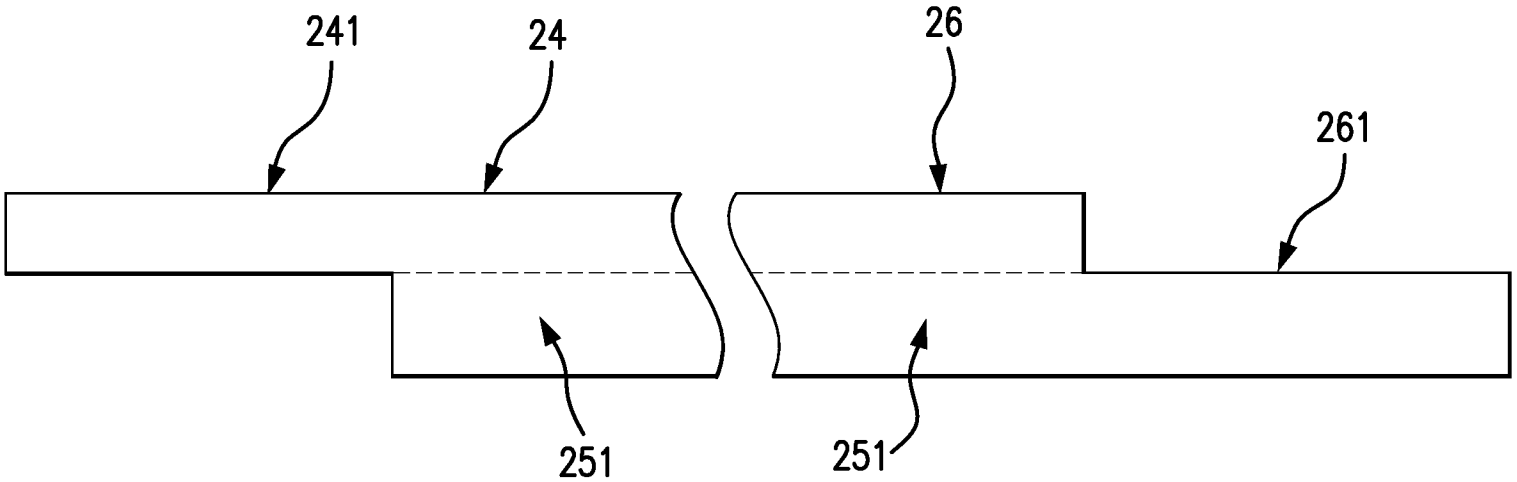
FIG. 5 is a cross-sectional side according to line III-III in FIG. 1.

FIG. 5 shows an exemplary third edge 24 and fourth edge 26 of a plank such as shown in FIG. 2, which also includes side edges 20 and 22 and a detachable connector 84 that is generally shown here without the details. The third and fourth edges can have other optional profiles for mechanical connection. As illustrated in FIG. 5, the third edge 24 has an extending downward facing protruding lip 241, and the opposite fourth edge 26 has an extending upward facing shoulder 261. Edges 24 and 26 extend from plank body or core 251. The third edge 24 can have any shape or configuration to mate with fourth edge 26 of a similarly configured plank. For example, the protruding lip profile 241 of the third edge 24 and the shoulder 261 of the fourth edge 26 of the plank outline can comprise various mating configurations such as described in U.S. Patent Application Publication No. 2007/0022694 A1, which is incorporated in its entirety by reference herein. As indicated, the plank, as an alternative to the FIG. 5 design, can include a variety of other designs on the third and fourth edges of the plank. Alternatively, for example, opposing third and fourth edges of the plank can comprise a pair of grooved edges, which may be joined to the edges of similarly configured adjacent planks with a spline connector. Also, alternatively, the third and fourth edges can have a non-mechanical locking tongue and groove profile, respectively, or can have conventional mechanical locking tongue and groove profile, respectively. Alternatively, the plank can include an additional pair of opposite third and fourth edges configured to have a tongue-profiled edge, a rib-profiled opposite edge, and a detachable connecter that can mate with either edge, similar to the connection system provided on the first and second edges. Other designs can also be used on the third and fourth edges.

The planks, inclusive of the plank members and side edges, can be constructed of materials such as polymeric materials, woods, resin-wood composites, various types of laminate, and other conventional materials used in the laminate or plank flooring industry. The plank can comprise an edged plank member that can be made, for example, from homogenous polymer material, solid wood, engineered wood, wood based material, like fiberboard (e.g., MDF, HDF), particle board, plywood, oriented strand board, chip board, various types of laminate composites, such as high-pressure laminates, natural, organic, recycled, or synthetic materials, solid wood, engineered wood, and the like. A plank can preferably comprise, for example, a core made from solid wood, particle board, plywood, HDF, or MDF, which can be covered with one more top layers or underlay layers laminated thereto. Non-limiting examples of plank materials constructed in the form of laminates that can used are illustrated, for example, in U.S. Pat. No. 6,617,009 and U.S. Patent Application Publication No. 2007/0022694 A1, which both are incorporated in their entireties by reference herein. The features of the first and second edges, and also those of the third and fourth edges, if also profiled, can be formed at respective sides of the plank by extrusion, molding, embossing, cutting, milling, or are formed by other suitable techniques, depending in part on the type of material being shaped.

Figure 6:
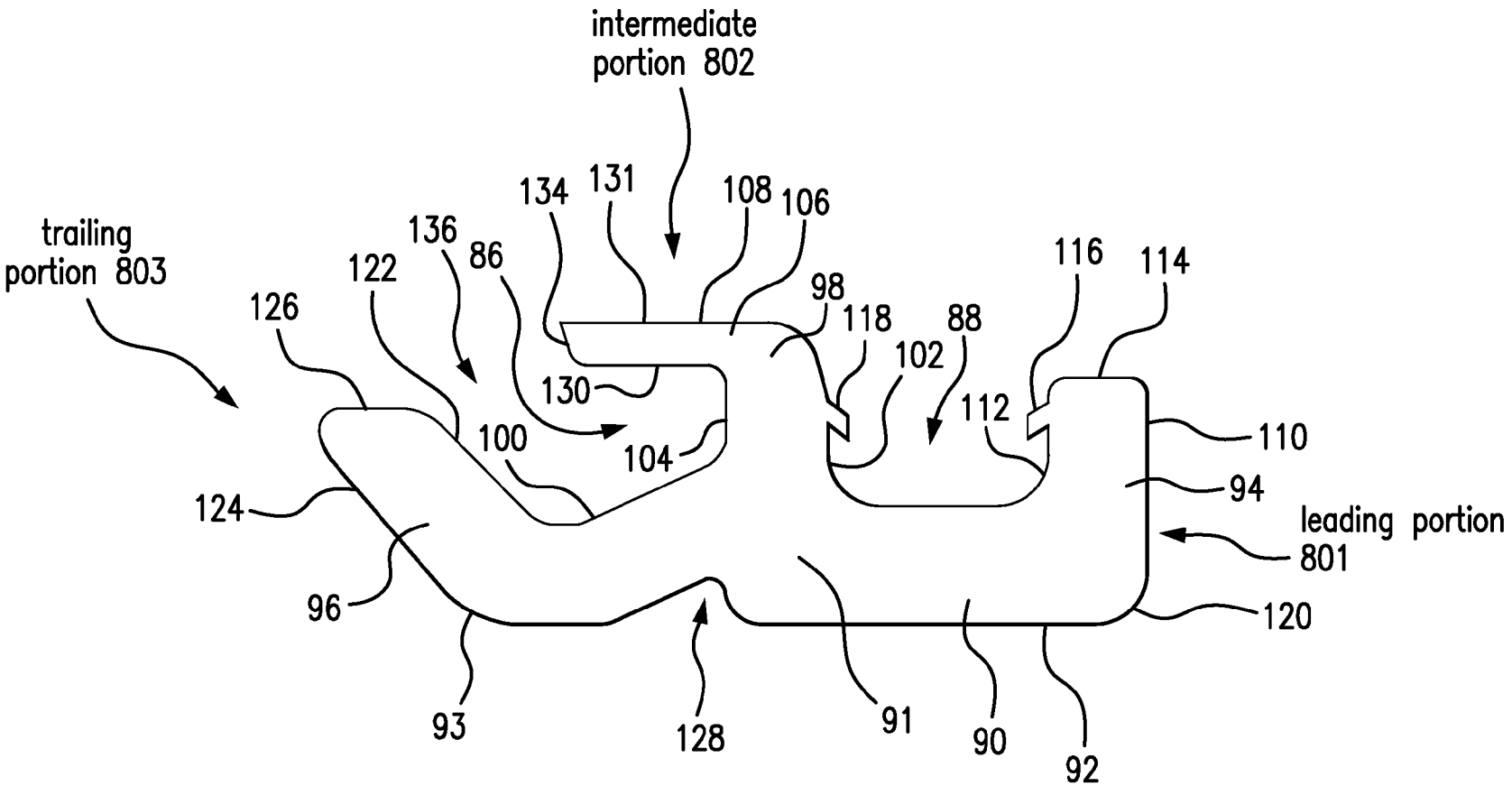
FIG. 6 is a side view of multidirectional connector connectible with either of the first and second edges of the plank shown in FIG. 2.

FIG. 6 shows an exemplary embodiment of a connector 84 that can be detachably connected, for example, with either of the opposite first and second edges 20 and 22 of the plank of FIG. 2. The connector is shown as including a leading portion 801, an intermediate portion 802, and a trailing portion 803. The connector comprises a groove 86 configured to receive the tongue 36 of the first edge 20 of the plank 12 for detachable connection thereto, and also a rib-receiving portion 88 configured to receive the downwardly extending rib 60 of the second edge 22 of the plank for detachable connection thereto. The connector 84 can further comprise a bottom 90 that can be positioned on the underlying support surface upon which the planks 12 are placed. The bottom 90 can comprise a flat bottom surface 92 that lies on a first plane, and an angled bottom surface 93 that forms an angle with respect to the first plane. The first plane can correspond with the surface of the floor or substrate upon which the planks 12 rest. The connector 84 can comprise a first or leading arm 94 extending upward from the bottom 90, a second or trailing arm 96 extending upward from the bottom 90, and a third or intermediate arm 98 extending upward from the bottom 90 and disposed between arm 94 and arm 96. The rib-receiving portion 88 can be disposed between arm 94 and arm 98. The rib-receiving portion 88 can be at least partially defined by arm 94 and arm 98. The groove 86 can be disposed between the intermediate arm 98 and arm 96. The groove 86 can be at least partially defined by the intermediate arm 98 and the trailing arm 96. The groove 86 can comprise a slanted bottom surface 100 that is slanted with respect to the first plane. The intermediate arm 98 can comprise a first intermediate wall 102 extending vertically upward from the bottom 90, a second intermediate wall 104 extending vertically upward from the bottom 80 and intersecting with the slanted bottom surface 100. Arm 98 can comprise a horizontal extension 106 extending from the second intermediate wall 104 toward the trailing arm 96.

The horizontal extension 106 can comprise a planar top surface 108 that is parallel to the first plane. The horizontal extension 106 can comprise a planar bottom surface 130 extending from the second intermediate wall 104, and a vertical lip 134 extending between the planar top surface 108 and the planar bottom surface 130.

Arm 94 of the connector 84 can comprise a first leading wall 110 extending vertically upward from the bottom 90, a second leading wall 112 extending vertically upward from the bottom 90, and a top planar surface 114 extending between the first leading wall 110 and the second leading wall 112. The connector 84 can optionally comprise a first latch 116 and a second latch 118. The first latch 116 can protrude from the second leading wall 112 of arm 94 into the rib-receiving portion 88. The second latch 118 can protrude from the first intermediate wall 102 into the rib-receiving portion 88. The first leading wall 110 can comprise an angled bottom portion 120 that extends to the bottom 90 of the connector 84.

Arm 96 can comprise a first trailing wall 122 extending diagonally upward from the bottom 90, a second trailing wall 124 extending diagonally upward from the bottom 90, and a top planar surface 126 or distal end extending between the first trailing wall 122 and the second trailing wall 124. The top planar surface 126 can be parallel to the first plane. The bottom 90 of the connector 84 can comprise a nook 128 that rises above the first plane. An access opening 136 is defined in the space between the first trailing wall 122 and the vertical lip 134 of the horizontal extension 106.

Figure 7:
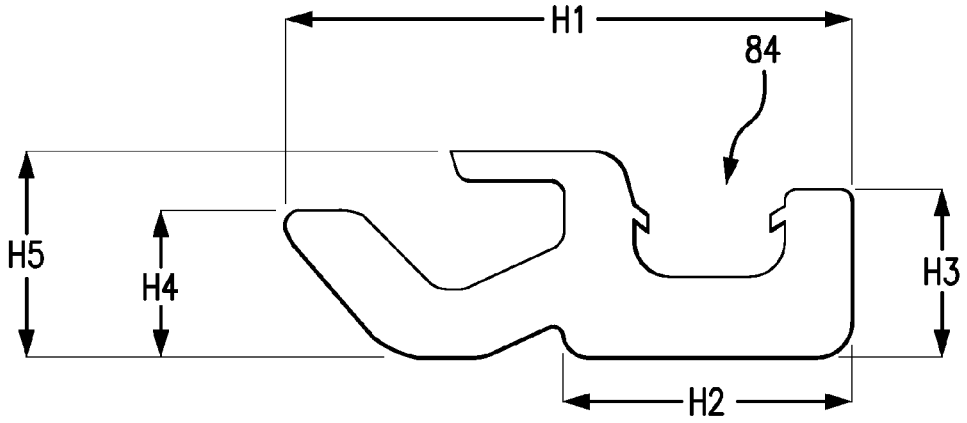
FIG. 7 is a cross sectional side view of the connector of FIG. 6 showing exemplary dimensions thereof.
Figure 8:
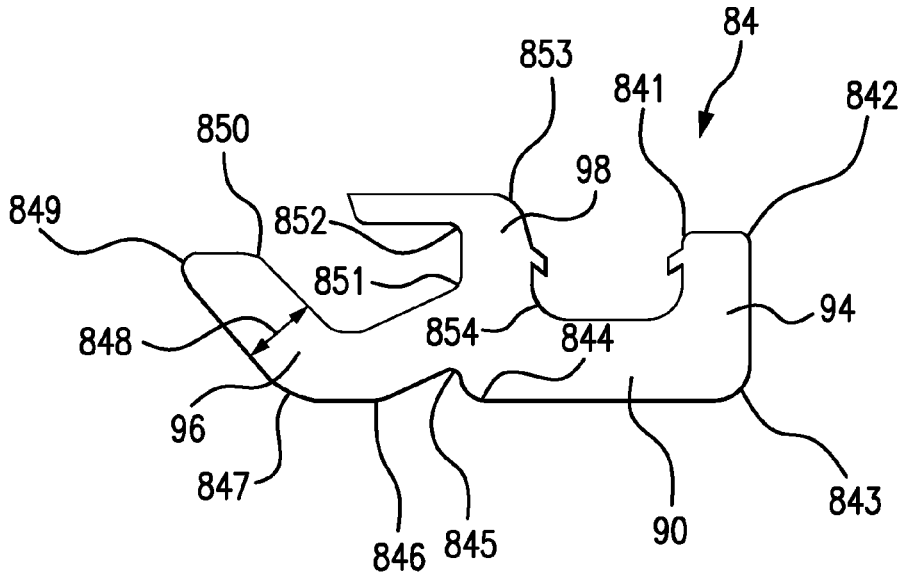
FIG. 8 is a cross sectional side view of the connector of FIG. 6, showing additional exemplary dimensions thereof.

The connectors and the planks can be configured to have any suitable dimension, as long as the planks are prevented from moving horizontally relative to the first plane, once they are connected to the connector. FIG. 7 shows exemplary measurements for various parts of the connector 84, which measurements are designated H1, H2, H3, H4, and H5. H1 can be 0.613 inch, H2 can be 0.31 inch, H3 can be 0.178 inch, H4 can be 0.151 inch, and H5 can be 0.217 inch. As an example, any one or more of these measurements can be (or vary) ±20%, ±15%, ±10%, ±5%, ±2%, ±1% from one or more of these particular measurements. FIG. 8 shows exemplary measurements for various parts of connector 84, which measurements are designated 841-854, wherein dimensions 841-847 and 849-854 refer to radii of curvature and 855 refers to a width of arm 96. According to various embodiments, 841 can be 0.015 inch, 842 can be 0.015 inch, 843 can be 0.030 inch, 844 can be 0.015 inch, and 845 can be 0.015 inch, 846 can be 0.018 inch, 847 can be 0.06 inch, 848 can be 0.081 inch, 849 can be 0.015 inch, 850 can be 0.015 inch, 851 can be 0.018 inch, 852 can be 0.018 inch, 853 can be 0.05 inch and 854 can be 0.03 inch. As an example, any one or more of these measurements can be (or vary) ±20%, ±15%, ±10%, ±5%, ±2%, ±1% from one or more of these particular measurements.

The connector 84 of the mechanical locking system can be made from materials that are the same or different from the plank 12. The connector 84 can be made from a polymeric material, such as thermoplastic material. The connectors 84 also can be made from rigid plastic, wood, composites or other materials that can be shaped into the structures such as illustrated herein. In various embodiments, the connectors 84 are an extruded polymeric material in which the connector body 91 is formed as a rigid, shape-retentive homogenous thermoplastic material. The connector 84 can be extruded to have a homogenous body 91. The connector body 91 can be polymeric materials such as polyvinyl chloride or polyvinyl chloride/rubber blends in other thermoplastic materials. Other polymers that are extrudable or moldable, such as injection moldable, can be used. The latches 116 and 118 of the connector 84 can be made from a relatively softer thermoplastic material, such as polyvinyl chloride. The connector body 91 can have a Durometer hardness (Shore D) of about 65 to about 85, and the latches have a Durometer hardness (Shore A) of about 50 to about 100, both as measured in accordance with ASTM D2240. The connector body and the latches can have relative hardnesses that differ by at least 10%, or from about 15% to about 30%. The connector 84 can be extruded as a single (unitary) track or unit.

As polymeric materials, unlike wood and wood-based materials, can be easily molded or extruded into a variety of shapes, the connector 84 can be configured into a shape, such as illustrated herein, providing a strong interconnection between planks. Consequently, the side edges of the plank can be configured such that the durability of the individual plank is not sacrificed. In other words, the connector can be easily configured to meet the function and strength requirements for inter-connecting the edges of the plank.

The interlocking system used in the present invention generally involves a disengageable mechanical lock system that can provide a durable locking and holding of the floor surface or other surface-covering assembled from a plurality of the planks. The plurality of planks can be assembled and connected to each other in parallel rows along adjacent side edges and adjacent end edges. The planks can include a first mechanism for detachably locking together side edges of adjacent planks and a second mechanism to connect adjacent end edges of adjacent planks. The first mechanism includes planks having a first side edge comprising a tongue and an adjacent first recess, and a second side edge comprising a downwardly extending rib and an adjacent second recess. A connector joins a first side edge of a plank to a second side edge of an adjacent plank wherein the connector comprises a groove receiving the tongue of the first edge of the plank and a rib-receiving portion receiving the downwardly extending rib of a second edge of the adjacent plank. The second mechanism can comprise any detachable mechanical connection made between the adjacent third and fourth end edges. The parallel rows of planks can be assembled to have similar or staggered end positions relative to adjacent rows.

Figure 9:
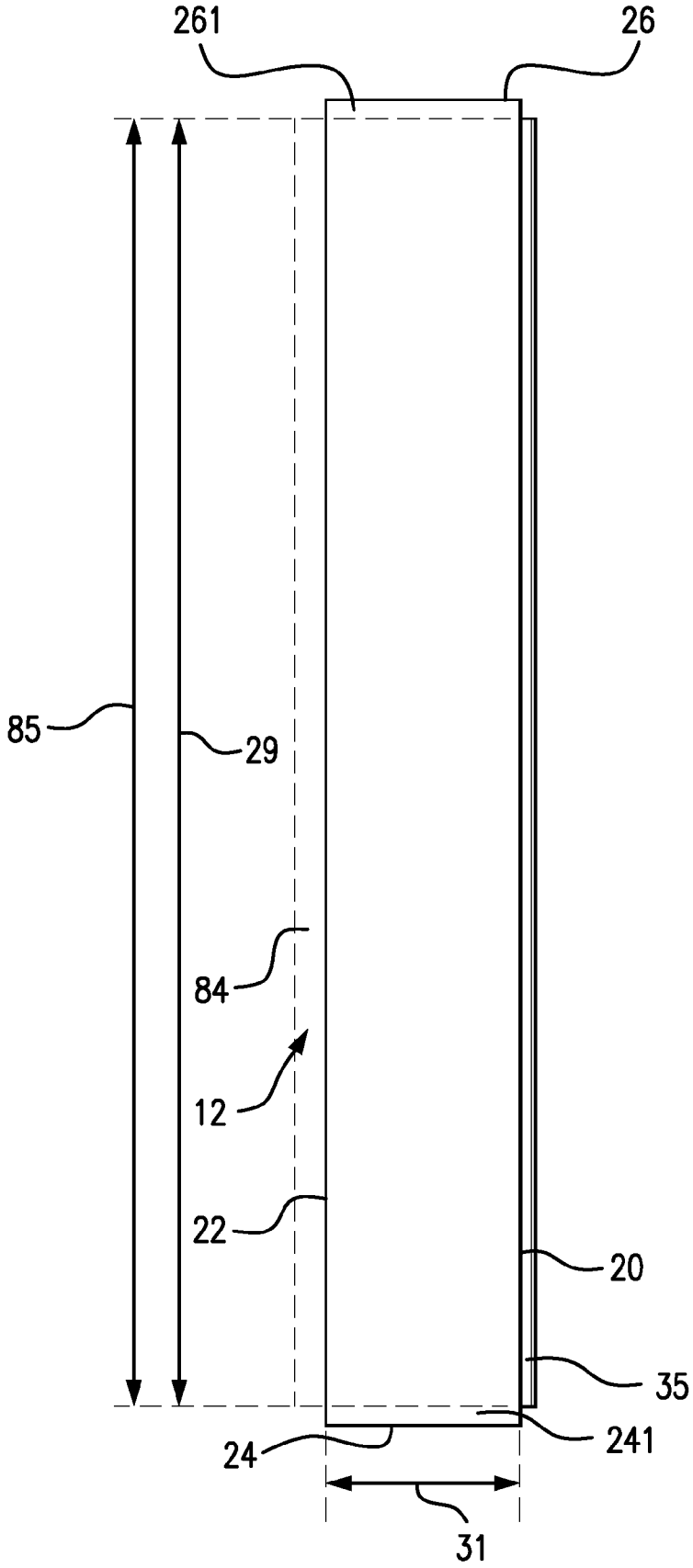
FIG. 9 is a plan view of the plank of FIG. 1.

Referring to FIG. 9, the opposite pair of parallel side edges 20 and 22 can have lengths 29 that preferably are substantially the same, and likewise with respect to the lengths 31 of the opposite pair of end edges 24 and 26. Further, the side edges and end edges can have different or similar lengths with respect to each other. For example, one pair of opposite edges can have a length that is shorter, longer or the same as the length of the other pair of opposite edges on the plank. The edge profile features such as illustrated herein can be provided at the side and/or end edges of the plank so as extend along at least predominant amount of the applicable edge length, and preferably at least 90% up to substantially 100% of the applicable edge length. The edge profile features can extend continuously along the associated edge, or, alternatively, some limited interruption or interruptions in the edge profile may be tolerated such as where sufficient pullout strength between adjacently connected planks can be provided and maintained. The connector preferably presents its connective profile structures along substantially its entire length 85. Some limited interruption(s) in the connection features along the connector likewise may be tolerated in other embodiments such where such interruptions, if they occur, do not unduly compromise the desired connections to be made with the side edges.

Figure 10:
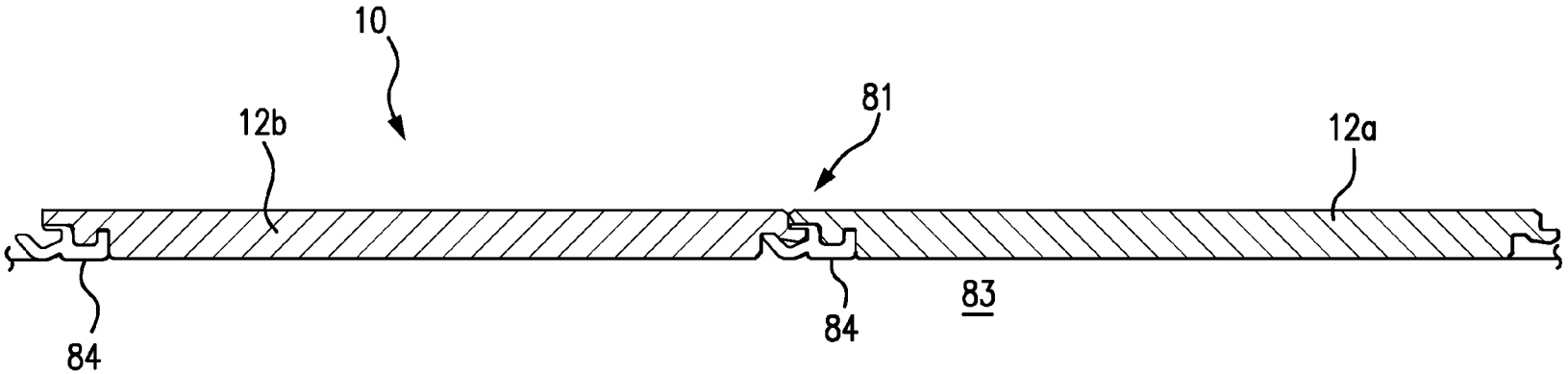
FIG. 10 is a cross-sectional side view through a plurality of connected planks of a flooring system according to various embodiments of the present invention.

FIG. 10 shows an exemplary view of a flooring system 10, where in a preferred embodiment at least two floor planks, 12*a* and 12*b*, are designed to mutually connect with a connector 84 that is disposed between the two floor planks, 12*a* and 12*b*. In combination, the connector 84 and mutually joined plank edges represent a connection system 81. When connected, such on a generally flat base or support structure 83, can prevent movement or drift in a vertical or horizontal direction with respect to each other. The connector 84 is disengageable relative to the planks 12*a* and 12*b* to permit the disassembly of the flooring or repair or replacement of one or more planks of the assembly.

Figure 11:
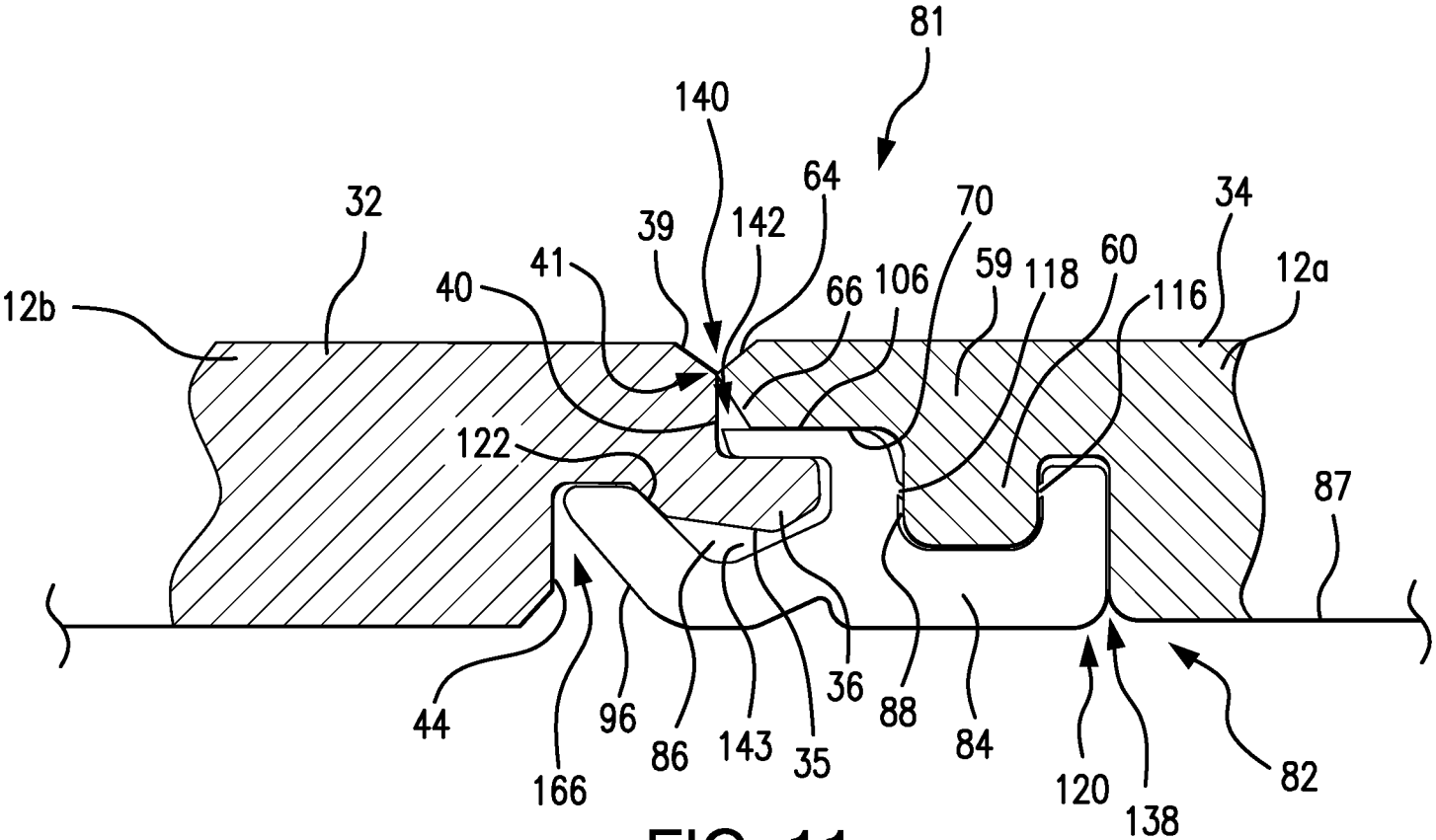
FIG. 11 is an enlarged view showing the connection system of the plurality of connected planks of FIG. 10.

FIG. 11 shows an exemplary enlarged view a connection system 81 of the surface-covering of FIG. 10. Rib profile 59 on trailing edge 34 can comprise a profile that is substantially or fully complementary to the shape of the rib-receiving portion 88 of connector 84. Leading edge 32 can comprise a tongue profile 35 that is substantially or fully complementary to the shape of the groove 86 of connector 84. As used herein, the phrase "substantially complementary" means that when operatively connected, one or more gaps are formed between the connector 84 and the leading edge 32 of the plank or the connector 84 and the trailing edge 34 of the plank. For example, the tongue profile 35 and the outline of the groove 86 are not identical from the standpoint that they would match each other like a square cube going into a recess having the same square dimensions. In other words, the outline of the groove 86 does not at all mimic the tongue profile 35 and the two profiles are significantly different or are not mirror images of each other.

As also shown in FIG. 11, the connector 84 can be connected to the trailing edge 34 of a first plank 12*a*, which is situated on a first (horizontal) plane 87. The rib-receiving portion 88 of the connector 84 can engage the rib 60 depending from the first plank 12*a*. The leading arm 94 can simultaneously be received in a recess 62 of the trailing edge 34 (shown in FIG. 12). Once the rib 60 is positioned within the rib-receiving portion 88 of the connector 84. A first gap 138 can be formed between the angled bottom portion 120 of the connector 84 and the vertical shoulder 82 of the groove-receiving edge 59. The rib 60 can abut the first and second latches, 116 and 118, respectively, of the connector 84, and the horizontal extension 106 can contact the first bottom planar surface 70 of the trailing edge 34. The first and second latches, 116 and 118, of the connector 84, can be compressed by the rib 60 to permit normal seam expansion and contraction, for example, swelling attributed to seasonal changes in temperature and humidity and settling of a building's formation. The first and second latches, 116 and 118, can also serve to prevent or minimize upward movement of the plank 12.

Figure 12:
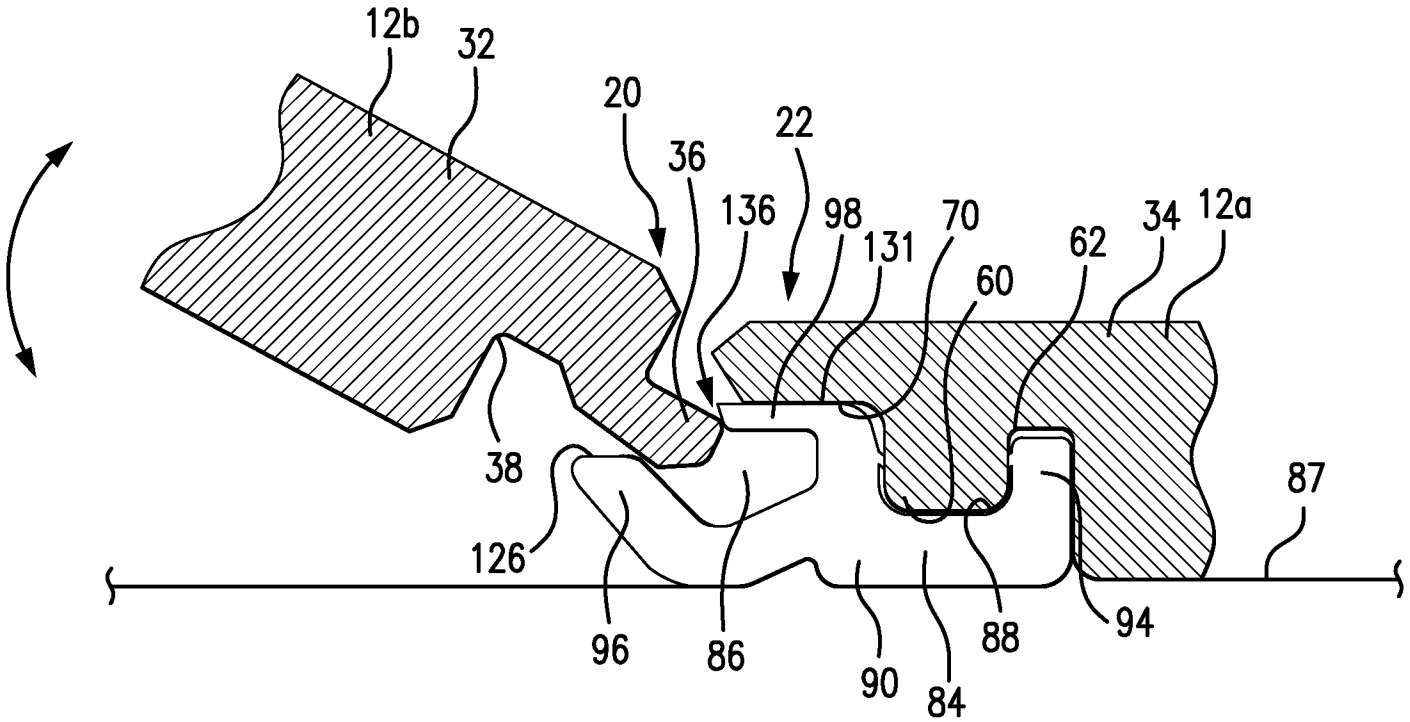
FIG. 12 is an enlarged view of a method of installing adjacent edges of planks to a shared connector.

As shown in FIG. 11 and/or FIG. 12, the tongue 36 of the leading edge 32 of floor plank 12*b* can be inserted into the groove 86 of the connector 84 through the access opening 136. The access opening 136 can be configured to require the leading edge 32 of a second floor plank 12*a* to approach the groove 86 at an angle, such as a slanted angle, relative to the first plane 87 in order for the tongue 36 of the leading edge 32 of the second floor plank 12*a* to be inserted into the groove 86. The angle at which the tongue 36 preferably can be positioned relative to the first plane in order to be inserted into the groove 86 can be from 1° to 40°, such as 1° to 30°, 1° to 25°, 1° to 20°, 5° to 20°, 5° to 15°, 3° to 10°, and the like, with the angle relative to the first plane.

The trailing arm 96 can be configured to be received in the first recess 38 of the leading edge 32 when the respective connector 84 holds together the leading edge 32 of a first floor plank 12*b* and the trailing edge 34 of a second plank 12*a*. Thus, once positioned within the groove 86 of the connector 84, the tongue 36 can contact the horizontal extension 106 and at least a part of the first trailing wall 122 (such as shown in FIGS. 6 and 11) of the connector 84. A second gap 140 can be formed between the inclined top portion 39 of the first plank 12*a* and the first slanted surface 64 of the second plank 12*b*. The junction 41 (such as shown in FIGS. 3 and 11) of plank 12*b* can contact the joint of plank 12*a*. A third gap 142 can be formed between the second slanted surface 66 of the trailing edge 34 and the vertical shoulder 40 of the leading edge 32. A fourth gap 143 (shown in FIG. 11) can be formed within the groove 86. A fifth gap 166 can be formed between the trailing arm 96 of the connector 84 and the vertical distal surface 44 of the leading edge 32.

The leading edge and the trailing edge are designed such that the leading edge and the trailing edge can be connected multiple times to the connector without a decrease in locking strength and also, or alternatively, without a decrease in the tightness of the mechanical lock. With many previous conventional tongue and groove systems in which the groove is formed from wood or wood-based materials, the connecting of the tongue with the groove can only be done once or twice before the integrity of the tongue and/or groove dramatically decreases, resulting in a mechanical lock that is loose or faulty. According to the present teachings, however, multiple connecting of the leading edge and the trailing edge with the connector is enabled while retaining connecting strength and tightness of the mechanical lock, for example, which is the same or better as compared to the first time that the plank and the connector are connected together. The connection system of this embodiment substantially reduces, if not eliminates, the risk of damaging a plank to the extent that it is inoperable. This is a significant advantage in relation to the use of the planks for "floating floor" surfaces and temporary flooring constructions which can be designed to be removed and reassembled many times. The system of the present invention provides connectors, which are rigid, but have enough flexibility to permit attachment to a plank. The connectors are easy and economical to replace, when compared to the cost of a new plank.

If gaps are provided, each gap provides a spacing between adjacent surfaces of the plank 12*a* and 12*b* and the connector 84 and the spacing is no more than 11% of the thickness of the plank, such as from 1% to 11%, from 1.25% to 8%, from 1.4% to 6%, from 1.5% to 4%, from 1.7% to 3%, or from about 1.7% to 2% of the thickness (height) of the plank. The joined planks can have no play or can have play (e.g., lateral movement once connected). With respect to the mechanical lock between the connector 84 and the trailing edge 32 or leading edge 34 in the present invention, as an option, there is no play between the connector 84 and the trailing edge 32 or leading edge 34. Furthermore, the system, according to the present teachings, can be configured such that there is no biasing or spring force once the planks 12 are connected to the plurality of connectors. Alternatively, the system, according to the present teachings, can be configured such that a biasing or spring force or tension is created when the planks are connected to the plurality of connectors.

As other advantages and benefits, the pullout strength of a connection system comprising a connector between any two adjoining planks having the first and second edges can be, for example, at least about 10 pli, particularly at least about 50 pli, and more particularly at least about 20 pli, as measured by ASTM D 638. The connector also is configured to permit the connecting of individual planks or tiles together in length and/or width directions to form an interlocking system, such as a monolithic surface covering, without the need for any installation adhesive underneath to hold the product together and, further, preferably requires minimum preparation work for the sub-floor or sub-surface. The mechanical locking system can be invisible when looking from the top or walking surface of the surface covering.

With respect the various embodiments illustrated in FIGS. 2-12 relating to use of connector design 84 (as connector 14 of FIG. 1), while the tongue profile and the groove-receiving edge have been described for the first pair of edges, 20 and 22, it should be understood that the first pair of edges 20 and 22, and/or the second pair of edges 24 and 26, of the floor plank 12 can comprise a leading edge 32 comprising a tongue profile 35, and a trailing edge 34 comprising a rib profile 59, as described herein. Thus, for a four-sided plank 12, both the first pair of edges, 20 and 22, and the second pair of edges 24 and 26, can comprise a leading edge 32 that comprises a tongue profile 35, and a trailing edge 34 comprises a rib profile 59, as described herein. Alternatively, either the first pair of edges, 20 and 22, or the second pair of edges, 24 and 26, can comprise a leading edge 32 comprising a tongue profile 35, and a trailing edge 34 comprising a rib profile 59, whereas the remaining two edges of a four-sided plank can have other connecting means. As indicated, the plank also can include a variety of designs on the other edges of the plank, such as additional mating edges that permit the plank to be assembled with other planks from additional directions.

Figure 13:
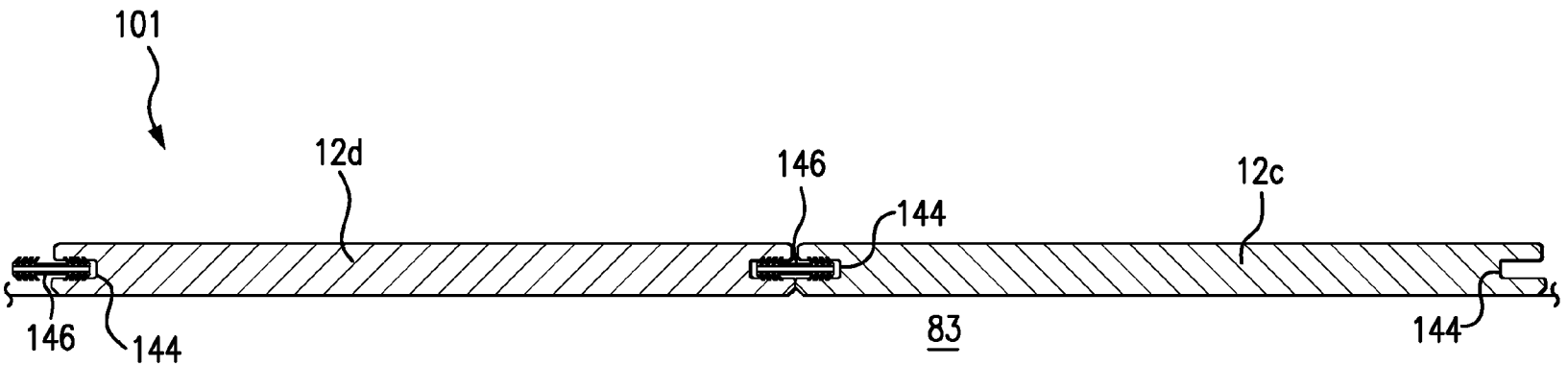
FIG. 13 is a cross-sectional side view through two planks of a flooring system interconnected by a different connection system according to other various embodiments of the present invention.

FIG. 13 shows a connection system according to other teachings of the present invention in which a co-extruded spline connector is used to connect grooved edges of adjacent planks. In these various optional embodiments of the present invention, and with reference again to FIG. 1, either the first pair of edges 20 and 22 and/or the second pair of edges, 24 and 26, of the floor plank 12, can comprise a pair of grooved edges 144 which can be mechanically interconnected with a spline connector 146.

Figure 14:
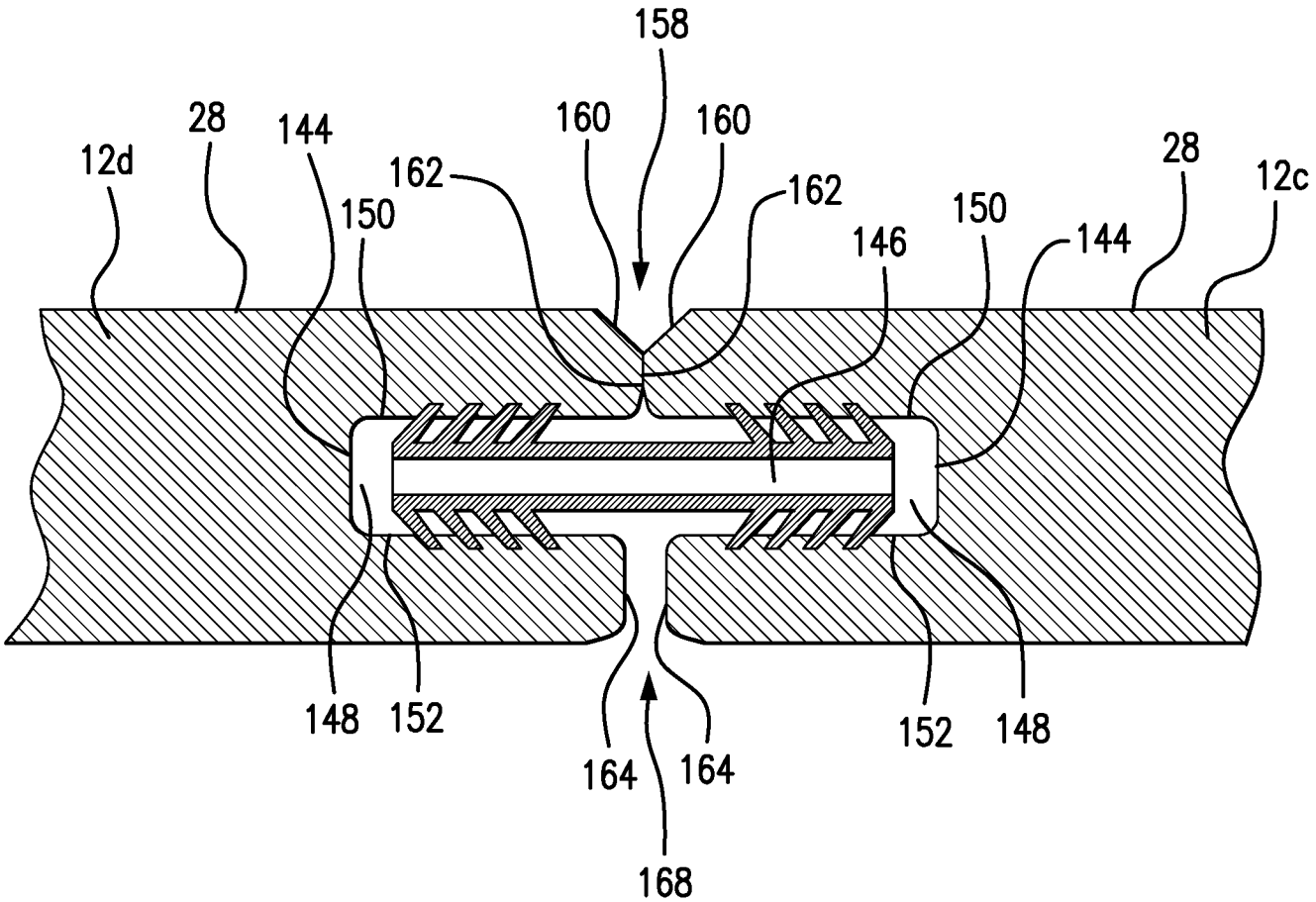
FIG. 14 is an enlarged view of the connected edges of the two planks shown in FIG. 13.

As shown in FIG. 13, the two exemplary floor planks 12*c* and 12*d* of the flooring system 10 alternatively can comprise a pair of opposite grooved edges 144 and the edge connectors can comprise one or more spline connectors 146. Each of the spline connectors 146 can be configured to connect together the grooved edges 144 of the two or more floor planks 12*c* and 12*d* of the flooring system 101. As illustrated in FIG. 14, each grooved edge 144 can comprise an inclined upper wall 160 extending diagonally from the top surface 28 of the plank 12*c* or 12*d*, a first vertical shoulder 162 extending vertically downward from the inclined upper wall 160, a second vertical shoulder 164 extending to the bottom surface of the plank, and a groove 148 defined within the planks 12*c* and 12*d*, between the first vertical shoulder 162 and the second vertical shoulder 164. Upper walls 160 are optional and can instead be 90° or nearly 90° C. corners such that each 160 wall essentially contacts each other on the top surfaces 28. The groove 148 that extends into the respective edge of the floor plank 12 by a depth. Each grooved edge 144 can comprise a top sidewall 150 that is smooth along the entirety of the depth, and a bottom sidewall 152 that is smooth along the entirety of the depth.

Once the grooved edges 144 of first plank 12*c* and the grooved edges 144 of second plank 12*d* are connected together with the spline connector 146, an optional v-shaped indentation 158 can be created between the top surface 28 of the first plank 12*c* and the top surface 28 of the second plank 12*d*. The top surface 28 of the first plank 12*c* does not contact the top surface 28 of the second plank 12*d*, once the first plank 12*c* and the second plank 12*d* are connected together with the spline connector 146. The first vertical shoulder 162 of the first plank 12*c* can contact the first vertical shoulder of the second plank 12*d* once the first plank 12*c* and the second plank 12*d* are connected together with the spline connector 146. A sixth gap 168 can be formed between the second vertical shoulder 164 of the first plank 12*c* and the second vertical shoulder 164 of the second plank 12*d* once the first plank 12*c* and the second plank 12*d* are connected together with the spline connector 164.

Figure 15:
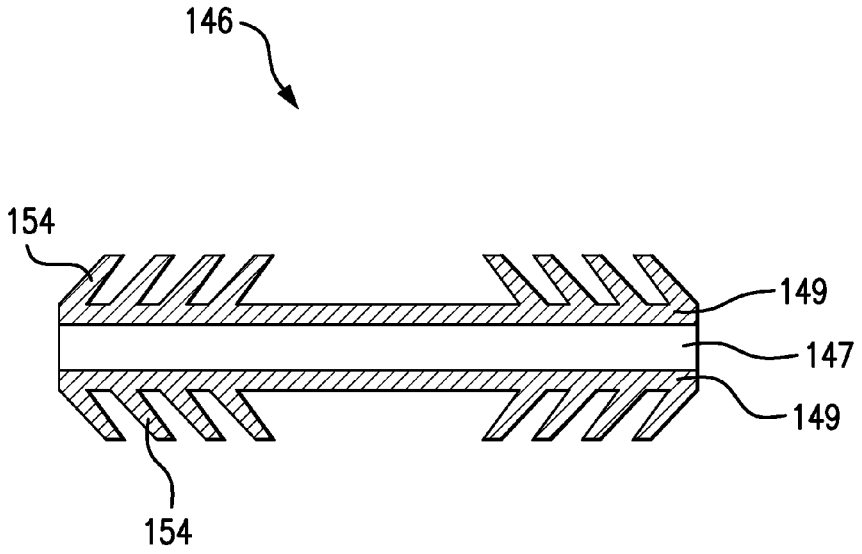
FIG. 15 is side view of a spline connector used in the connection system of FIG. 13 according to various embodiments of the present invention.

As shown in FIG. 15, the spline connector 146 can comprise a rigid center spline 147. Outer support sheets 149 are disposed on the top and bottom surfaces of the center spline 147. The outer support sheets 149 can comprise teeth 154 that point outward with respect to a direction of insertion into a respective grooved edge 144. Preferably, the spline connector 146 is a co-extruded material. The center spline can be made of a rigid thermoplastic material such as polyvinyl chloride or polyvinyl chloride/rubber blends, and the outer support sheets can be made of a soft thermoplastic material such as soft polyvinyl chloride in order to be flexible when inserted into the grooves 148 and to fit securely within the grooves 148.

The spline connector 146 can be inserted into the groove 148 of one plank 12*c* and is long enough to extend outside the groove 148 and fit into a respective groove 148 of another plank 12*d*, in order to connect the two planks, 12*a* and 12*b*, together. Once inserted into the grooves 148, the teeth 154 of the spline connector 146 can abut the top sidewall 150 and bottom sidewall 152 of the groove 148. The teeth 154 of the spline connector 146 can be compressed by the top sidewall 150 and bottom sidewall 152 of the groove 148. The teeth 154 can permit normal seam expansion and contraction, for example, swelling attributed to seasonal changes in temperature and humidity and settling of a building's formation. The teeth 154 can prevent or minimize movement between two planks 12*c* and 12*d* connected by the spline connector 146, toward and away from each other. With respect to the mechanical lock between the spline connector 146 and the grooved edges 144, there preferably is no play between the spline connector 146 and the grooved edges 144.

Figure 16:
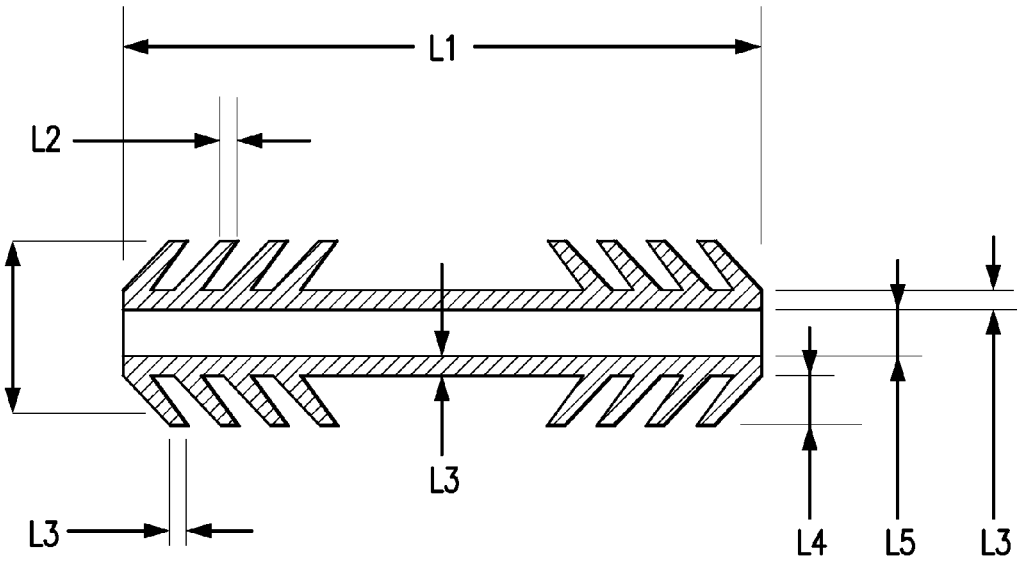
FIG. 16 is a side view of the spline connector of FIG. 15 showing exemplary dimensions thereof.

FIG. 16 shows exemplary measurements for various parts of the spline connector 146, which measurements are designated L1, L2, L3, L4, and L5. According to various embodiments, L1 can be 0.49 inch, L2 can be 0.015 inch, L3 can be 0.015 inch, L4 can be 0.036 inch, L5 can be 0.033 inch.

In various embodiments, the spline connector is a co-extruded unitary component. The spline connector can comprise a spline body that can be made from polyvinyl chloride or polyvinyl chloride/rubber blends, or other polymeric materials. The outer strips including the barbed portions of the spline connector can be made from a relatively softer thermoplastic material than the spline body. The outer strips can be made, for example, of polyvinyl chloride or other polymeric materials. In various embodiments, the spline body has a Durometer hardness (Shore D) of about 65 to about 85, and the outer strips have a Durometer hardness (Shore A) of about 50 to about 100, both as measured in accordance with ASTM D 2240. In various embodiments, the spline body and outer strips have relative hardnesses that differ by at least 23%, or about 15% to about 30%.

A method is also provided for assembling a plurality of floor planks. In a preferred embodiment, the method is used to detachably assemble the planks such as illustrated in FIGS. 2-12. In preferred embodiments, each of the plurality of floor planks have a first pair of edges that are parallel to one another, and a second pair of edges that are parallel to one another. The first pair of edges can comprise a leading edge having a tongue profile and a trailing edge having a groove-receiving edge. The tongue profile can have a tongue and a first recess. The trailing edge can have a downwardly extending rib and a second recess. The method can comprise connecting a connector having a groove and a rib-receiving portion to the trailing edge of at least a first floor plank oriented on a first plane, orienting the leading edge of a second floor plank at an angle relative to the first plane, inserting the leading edge of the second floor plank through an access opening of the groove, and positioning the tongue of the second plank within the groove of the first plank. In a preferred embodiment, a downwardly-extending rib of an edge of a first plank is inserted into a rib-receiving portion of a connector. The tongue edge of a second plank can be detachably locked into place in the same connector by inserting it at a slanted angle into a groove of the same connector, and rotating or pivoting the first and second planks relative to each other, effective to rotate the tongue relative to the groove in which it had been inserted, to lock the tongue in place relative to the groove to form a mechanical interlock therewith as the planks are brought into substantially co-planar orientation. The assembly of first and second edges of planks can comprise the use of a common (shared) connector that can include a leading connector arm, an intermediate connector arm and a trailing connector arm. The leading connector arm can be inserted in a recess defined in the rib-profiled side edge of the first plank in combination with the rib being received by rib-receiving portion of the connector, wherein an overlying portion of the rib-profiled side edge comes to rest on a horizontal-extending portion of an intermediate connector arm, which together with a separate trailing connector arm defines the groove. The trailing connector arm can be inserted in a separate recess defined in the tongue-side edge of the adjacent second plank in combination with the tongue rotating into locked position within the groove, such as illustrated in FIG. 12. As illustrated in FIG. 11, the resulting plurality of connected planks has multiple locking features to prevent lateral and vertical drift between connected adjacent planks. Also, a portion of the rib profiled edge of a plank comes to rest over the third connector while also abutting the adjoining plank edge to hide the connector from visible view (from a top surface view perspective). A third panel can be moved toward the first or second plank in a direction substantially perpendicular to the first edge of the first panel and substantially perpendicular to the second edge of the second panel wherein a third edge of the third panel is engaged with a fourth edge of the first or second panel wherein the first, second, and third panels are substantially coplanar. As previously indicated, other edges of the plank, such as the third and fourth edges, can include a variety of designs, such as mating edges that permit the plank to be assembled with other planks from additional directions.

For purposes of the present invention, in at least one embodiment, the planks of the present invention have at least the tongue profile on at least one edge of a plank, and a groove-receiving edge on at least one other edge of the plank (e.g., the opposing side), whereas the remaining two edges of a four-sided plank can have other connecting means, such as tongue/groove systems, mechanical lock systems, adhesive systems, and/or spline systems, and the like. It should also be understood that the tongue profile of the leading edge of the floor plank and the outline of the groove of the connector can comprise any conventional tongue and groove profiles. For example, the tongue profile of the leading edge of the floor plank and the outline of the groove of the connector can comprise the tongue and groove profiles described in U.S. Patent Application Publication No. 2007/0022694 A1, which is incorporated in its entirety herein by reference.

Examples of floor planks that can have the connecting system(s) of the present invention include, but are not limited to, the floor planks described in U.S. Pat. Nos. 6,101,778; 6,023,907; 5,860,267; 6,006,486; 5,797,237; 5,348,778; 5,706,621; 6,094,882; 6,182,410; 6,205,639; 3,200,553; 1,764,331; 1,808,591; 2,004,193; 2,152,694; 2,852,815; 2,882,560; 3,623,288; 3,437,360; 3,731,445; 4,095,913; 4,471,012; 4,695,502; 4,807,416; 4,953,335; 5,283,102; 5,295,341; 5,437,934; 5,618,602; 5,694,730; 5,736,227; and 4,426,820 and U.S. Published Patent Application Nos. 20020031646 and 20010021431 and U.S. patent application Ser. No. 09/460,928, and all are incorporated in their entirety by reference herein.

Thus, in at least one embodiment, the present invention encompasses any type of joint or connecting system that adjoins edges of floor planks together in some fashion with the use of straight edges, grooves, channels, tongues, splines, and other connecting systems for at least two edges. Although use of a bonding agent is not necessary, a bonding agent/composition can, optionally, be applied or be used to connect two or more planks together. The planks optionally can be joined together wherein at least a portion of the planks are joined together at least in part by an adhesive. An example of such a system is described in U.S. patent application Ser. No. 10/205,408, which is incorporated herein in its entirety.

For purposes herein, a preferred embodiment, flooring systems having planks or floor planks, are described. However, it is realized that this description equally applies to surface coverings in general. Furthermore, while the terms "floor plank" or "plank" are used, it is to be understood that the floor plank or plank includes any geometrical design, especially designs having four sides, and the four sides can be rectangular, including squares, and can be any length or width. The present invention is not limited by any length or width, nor any geometrical design.

The surface covering of the present invention can be for flooring surfaces, but is not limited to flooring systems. The surface-covering system of the present teachings can be used in a variety of applications including, but not limited to, wall planks, ceiling planks, decks, patios, furniture surfaces, shelves, deck planks, fascia, partition planks, horizontal surfaces, table tops, chest tops, counter tops, and other surface-coverings or parts thereof. The connecting system of the present invention can be used to connect a variety of surface covering products. Any surface covering product capable of being formed into a plank such that the surface covering of the present invention can be used as part of this invention to form the surface covering. For instance, laminate floor products can be connected by the connecting system of the present invention. Other floor products that can be connected together by the connecting system of the present invention include, but are not limited to, plastic-containing products, such as, for example, hard surface products.

The present invention includes the following aspects/embodiments/features in any order and/or in any combination:

1. The present invention relates to a plank comprising:
   - a first edge having a tongue;
   - a second edge having a downwardly-extending rib, wherein said first and second edges are on opposite sides of said plank; and
   - a disengageable connector having both a groove being detachably connectible with said tongue and a rib-receiving portion being detachably connectible with said rib, wherein said connector being detachably connected at the first edge or the second edge of the plank.

2. The plank of any preceding or following embodiment/feature/aspect, wherein said plank further comprises opposite third and fourth edges having profiled edges or straight edges.

3. The plank any preceding or following embodiment/feature/aspect, wherein the third and fourth edges comprise mechanically interconnectible profiled edges.

4. The plank of any preceding or following embodiment/feature/aspect, wherein said tongue comprises a cantilevered tongue.

5. The plank any preceding or following embodiment/feature/aspect, wherein said rib comprises a substantially square-shaped component extending vertically downward from the second edge.

6. A plank, comprising:
   - a first edge comprising a tongue and an adjacent first recess;

a second edge comprising a downwardly extending rib and an adjacent second recess, wherein said first and second edges are on opposite sides of said plank; and a disengageable connector alternatively attachable to the first edge and the second edge, said connector comprising a groove and a rib-receiving portion, said rib configured to receive the tongue of the first edge for detachable connection thereto, and said rib-receiving portion configured to receive the downwardly extending rib of the second edge for detachable connection thereto.

7. The plank of any preceding or following embodiment/feature/aspect, wherein the connector further comprises a first arm, a second arm and a third arm, wherein:

the first arm configured to be received in the second recess of the plank, and the first and third arms at least partially defining a rib-receiving portion configured to receive the downwardly extending rib of the plank, for detachable connection to the second edge of the plank; and the second arm configured to be received in the first recess of the plank, the second and third arms defining a groove configured to receive the tongue of the plank, for detachable connection to the first edge of the plank.

8. The plank of any preceding or following embodiment/feature/aspect, wherein, at the first edge, the tongue comprises a cantilevered tongue, and the first recess is located at a backside of the cantilevered tongue, wherein the first recess is configured to receive a distal end of said second arm.

9. The plank of any preceding or following embodiment/feature/aspect, wherein the third arm further comprising having an initial upward extending portion and an integral horizontal extension extending toward the distal end of the third arm, wherein the horizontal extension has a planar lower and upper sides wherein the upper side being configured such that a bottom planar surface of a second edge of a plank is configured to rest thereon when the downwardly extending rib of the plank is received in the rib-receiving portion and the first arm is received in the second recess.

10. The plank of any preceding or following embodiment/feature/aspect, wherein the second arm further comprising an upper multi-angled surface defining a groove bottom, wherein the groove has an access opening configured to allow the tongue of the first edge to enter the groove at a slanted angle relative to the horizontal extension and rotate after entry into said groove into mechanical interlock with the lower planar side of the horizontal extension of the third arm and the groove bottom defined by the upper multi-angled surface of the second arm.

11. The plank of any preceding or following embodiment/feature/aspect, wherein first arm and said third arm each further comprises a standoff latch configured to protrude into the rib-receiving portion to frictionally interfit with the downward extending rib when received in the rib-receiving portion.

12. The plank of any preceding or following embodiment/feature/aspect, wherein the connector further comprising:

a bottom comprising a flat bottom surface portion that lies on a first horizontal plane;

first, second and third arms, wherein the first arm extending upward from the bottom, said first arm configured to be received in the second recess of the plank wherein the first arm comprises first and second sidewalls extending vertically upward from the bottom, and a top planar surface extending between the first and second sidewalls, the second arm curving upward from the bottom, said second arm terminating in a distal end configured to be received in the first recess of the plank and having a multi-angled upper surface defining a groove bottom, the third arm being located intermediate the first and second arms, said third arm extending upward from the bottom and including an initial vertical upward extending portion and an integral horizontal extension extending toward the distal end of the second arm, wherein the horizontal extension having lower and upper planar sides;

the rib-receiving portion is at least partially defined between the first arm and the third arm;

a bottom planar surface of the second edge of the plank configured to rest on an upper planar side of the horizontal extension when the downwardly extending rib of the plank is received in the rib-receiving portion and the third arm is received in the second recess; and the groove is at least partially defined between the upper multi-angled surface of the second arm and the third arm, wherein the second and third arms define an access opening to the groove configured to allow the tongue of the first edge to enter the groove at a slanted angle relative to the horizontal extension and to rotate after entry into said groove into mechanical interlock with the lower planar side of the horizontal extension of the third arm and the upper multi-angled surface of the second arm.

13. The plank of any preceding or following embodiment/feature/aspect, wherein the first arm further comprising a first arm latch and the third arm further comprising a third arm latch, wherein said first arm and third arm latches are configured to protrude into the rib-receiving portion so as to abut the downward extending rib when received in the rib-receiving portion.

14. The plank of any preceding or following embodiment/feature/aspect, wherein the bottom of the connector comprises a nook that rises above the first plane.

15. The plank of any preceding or following embodiment/feature/aspect, further comprising third and fourth edges extending between said first and second side edges, wherein said third edge comprising a profiled or straight edge, and the fourth edge comprising a profiled or straight edge, wherein said fourth edge is located opposite of said third edge.

16. The plank of any preceding or following embodiment/feature/aspect, wherein the third and fourth edges extend between said first and second side edges, wherein said third and fourth side edges have complementary shapes configured for mechanical interconnection with different planks having similar edges as said third and fourth side edges.

17. The plank of any preceding or following embodiment/feature/aspect, wherein the third edge having an extending shoulder, and the opposite fourth edge has an extending protruding lip, wherein the shoulder is adapted to be received in a protruding lip extending along a fourth edge of a similarly configured adjacent plank.

18. The plank of any preceding or following embodiment/feature/aspect, wherein the third edge comprising a third edge groove and the fourth edge comprising a fourth edge tongue interfittable with third edge grooves in different planks having similar edges.

19. The plank of any preceding or following embodiment/feature/aspect, wherein the plank has a first length measured parallel to the first and second edges and between the third and fourth edges and the connector has a second length substantially the same as the first length, wherein the tongue and adjacent first recess of the first edge, the downwardly extending rib and adjacent second recess of the second edge, extending along at least 90% of the first length, and the groove and rib-receiving portion of the connector extending along at least 90% of the second length.

20. The plank of any preceding or following embodiment/feature/aspect, wherein the plank further comprises a panel member having generally planar top and bottom surfaces, and said first, second, third and fourth edges are defined in side edges extending between said top and bottom surfaces.

21. A surface-covering system comprising a plurality of planks according to any preceding or following embodiment/feature/aspect.

22. A surface-covering system comprising a plurality of planks according to any preceding or following embodiment/feature/aspect.

23. A flooring system comprising a plurality of planks which are connected to each other in parallel rows along adjacent first and second side edges, and which are in contact with each other in parallel rows along an adjacent third and fourth end edges, said planks comprise a first mechanism for locking together said first and second side edges and a second mechanism to connect said third and fourth end edges; wherein said first mechanism comprises a first edge comprising a tongue and an adjacent first recess, a second edge comprising a downwardly extending rib and an adjacent second recess, wherein said first and second side edges are parallel to one another, and a third end edge comprising a profiled or straight edge, a fourth end edge comprising a profiled or straight edge, wherein said third and fourth end edges are parallel to one another, and a connector joining a first side edge of a plank to a second side edge of an adjacent plank, said connector comprising a groove configured to receive the tongue of the first side edge of the plank and a rib-receiving portion configured to receive the downwardly extending rib of a second side edge of the adjacent plank, wherein the connector being detachable from said first and second side edges of the planks.

24. The flooring system of any preceding or following embodiment/feature/aspect, wherein the connector further comprises a first arm, a second arm and a third arm, wherein:

the first arm configured to be received in the second recess of the adjacent second plank, and the first and third arms at least partially defining a rib-receiving portion configured to receive the downwardly extending rib of the second plank, for detachable connection to the second edge of the second plank; and the second arm configured to be received in the first recess of the first plank, the second and third arms defining a groove configured to receive the tongue of the first plank, for detachable connection to the first edge of the plank.

25. The flooring system of any preceding or following embodiment/feature/aspect, wherein, at the first edge of the first plank, the tongue comprises a cantilevered tongue, and the first recess is located at a backside of the cantilevered tongue, wherein the first recess is configured to receive a distal end of said second arm.

26. The flooring system of any preceding or following embodiment/feature/aspect, wherein the third arm further comprising having an initial vertical upward extending portion and an integral horizontal extension extending toward the distal end of the second arm, wherein the horizontal extension has a planar lower and upper sides wherein the upper side being configured such that a bottom planar surface of the second edge of the second plank is configured to rest thereon when the downwardly extending rib of the second plank is received in the rib-receiving portion and the first arm is received in the second recess of the second plank.

27. The flooring system of any preceding or following embodiment/feature/aspect, wherein the second arm further comprising an upper multi-angled surface defining a groove bottom, wherein the groove has an access opening configured to allow the tongue of the first edge of the first plank to enter the groove at a slanted angle relative to the horizontal extension and rotate after entry into said groove into mechanical interlock with the lower planar side of the horizontal extension of the third arm and the groove bottom defined by the upper multi-angled surface of the second arm.

28. The flooring system of any preceding or following embodiment/feature/aspect, wherein said first arm and said third arm each further comprises a standoff latch configured to protrude into the rib-receiving portion to frictionally interfit with the downward extending rib of the second plank when received in the rib-receiving portion.

29. The flooring system of any preceding or following embodiment/feature/aspect, wherein a plank further comprise a panel member having generally planar top and bottom surfaces, and said first, second, third and fourth edges are defined in side edges extending between said top and bottom surfaces.

30. The flooring system of any preceding or following embodiment/feature/aspect, wherein the second mechanism comprises a detachable mechanical connection made between the adjacent third and fourth edges.

31. A disengageable connector for assembling floor planks of a flooring system, comprising:

a bottom comprising a flat bottom surface portion;

first, second and third arms, wherein the first arm extending upward from the bottom, said first arm configured to be received in a recess of an adjacent plank wherein the first arm comprises first and second sidewalls extending vertically upward from the bottom, and a top planar surface extending between the first and second sidewalls, the second arm curving upward from the bottom, said second arm terminating in a distal end configured to be received in a recess of a plank and having a multi-angled upper surface defining a groove bottom, the third arm being located intermediate the first and second arms, said third arm extending upward from the bottom and including an initial upward extending portion and an integral horizontal extension extending toward the distal end of the second arm, wherein the horizontal extension having lower and upper planar sides;

a rib-receiving portion at least partially defined between the first arm and the third arm; and a tongue-receiving groove at least partially defined between the upper multi-angled surface of the second arm and the third arm.

32. A flooring system comprising a plurality of planks which are connected to each other in parallel rows along an adjacent first edge and an adjacent second edge, and which are in contact with each other in parallel rows along an adjacent third edge and an adjacent fourth edge, said planks comprise a first mechanism for locking together said first and second edges and a second mechanism to connect said third and fourth edges; wherein said first mechanism comprises first and second grooved edges connected by inserting a co-extruded barbed spline jointly into adjacent grooves defined in adjacent first and second edges, and said third edge and fourth edges comprising a profiled or straight edge having complementary shapes configured for mechanical interconnection with different planks having similar edges as said third and fourth side edges.

33. A method for joining floor planks into a surface covering, comprising:

providing a plurality of panels, wherein each panel comprises a first edge comprising a tongue and an adjacent first recess, a second edge comprising a downwardly extending rib and an adjacent second recess, wherein said first and second edges are on opposite sides of the plank, a third edge comprising a profiled or straight edge, and a fourth edge comprising a profiled or straight edge, wherein said fourth edge is located opposite of said third edge, and one or more connectors alternatively attachable to the first edge and the second edge of planks, wherein the connectors comprising a groove and a rib-receiving portion, said rib configured to receive the tongue of a first edge of a plank for detachable connection thereto, and said rib-receiving portion configured to receive the downwardly extending rib of a second edge of a plank for detachable connection thereto;

inserting a downwardly-extending rib of an edge of a first plank into a rib-receiving portion of a connector;

inserting a tongue located along the edge of an adjacent second plank at a slanted angle into a groove of the same connector;

rotating the first and second planks relative to each other to lock the tongue in place relative to the groove to form a mechanical interlock therewith as the planks are brought into substantially co-planar orientation; and moving a third panel toward the first or second plank in a direction substantially perpendicular to the first edge of the first panel and substantially perpendicular to the second edge of the second panel wherein a third edge of the third panel is engaged with a fourth edge of the first or second panel wherein the first, second, and third panels are substantially coplanar.

34. The method of any preceding or following embodiment/feature/aspect, further comprising providing said connector including a leading connector arm, an intermediate connector arm and a trailing connector arm.

35. The method of any preceding or following embodiment/feature/aspect, further comprising:

inserting the leading connector arm in a recess defined in the rib-profiled side edge of the first plank in combination with the rib being received by rib-receiving portion of the connector, wherein an overlying portion of the rib-profiled side edge comes to rest on a horizontal-extending portion of an intermediate connector arm, which together with a separate trailing connector arm defines the groove, and inserting the trailing connector arm in a separate recess defined in the tongue-side edge of the adjacent second plank in combination with the tongue rotating into locked position within the groove.

36. The method of any preceding or following embodiment/feature/aspect, wherein the third and fourth side edges have complementary shapes configured for mechanical interconnection with different planks having similar edges as said third and fourth side edges.

The present invention can include any combination of these various features or embodiments above and/or below as set forth in sentences and/or paragraphs. Any combination of disclosed features herein is considered part of the present invention and no limitation is intended with respect to combinable features.

Applicants specifically incorporate the entire contents of all cited references in this disclosure. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range. In some embodiments, dimensions provided herein for various structural features are for illustrative purposes only, and are in no way intended to limit the scope of the present invention.

Other embodiments of the present teachings will be apparent to those skilled in the art from consideration of the specification and practice of the present teachings disclosed herein. It is intended that the specification and examples be considered as exemplary only, with the true scope and spirit of the present invention being indicated by the following claims and equivalents thereof.

The invention claimed is:

1. A plank comprising:

a first edge having a tongue;

a second edge having a downwardly-extending rib, wherein said first and second edges are on opposite sides of said plank and comprise different mechanical interlocking structures; and a disengageable connector comprising a bottom, a first arm, a second arm and a third arm, each arm extending from the bottom, the bottom comprising a flat bottom surface portion that lies on a first horizontal plane, the connector further having a groove between the second arm and the third arm being detachably connectible with said tongue and a rib-receiving portion between the third arm and first arm being detachably connectible with said rib, wherein said connector being detachably connected at the first edge or the second edge of the plank, wherein the first arm extending upward from the bottom having first and second sidewalls extending vertically upward from the bottom, and a top planar surface extending between the first and second sidewalls, the second arm curving upwardly from the bottom surface portion of the connector and extending away from the third arm, and the third arm being located intermediate the first and second arms, said third arm extending upward from the bottom and including an initial upward extending portion and an integral horizontal extension extending toward a distal end of the second arm, wherein the horizontal extension having lower and upper planar sides.

2. The plank of claim 1, wherein said plank further comprises opposite third and fourth edges having profiled edges or straight edges.

3. The plank of claim 2, wherein the third and fourth edges comprise mechanically interconnectible profiled edges.

4. The plank of claim 1, wherein said tongue comprises a cantilevered tongue.

5. The plank of claim 3, wherein said rib comprises a substantially square-shaped component extending vertically downward from the second edge.

6. A surface-covering system comprising a plurality of planks according to claim 1.

7. The plank of claim 1, wherein the tongue on the first edge of the plank extends from a vertical shoulder of the first edge towards the connector.

8. The plank of claim 1, wherein the third arm being located intermediate the first and second arms, said third arm extending upward from the bottom and including an initial upward extending portion and a single integral horizontal extension comprising a planar top surface that is parallel to the first horizontal plane, wherein the single integral horizontal extension extends towards the distal end of the second arm.

9. The plank of claim 1, wherein the second arm has a top planar surface parallel to the first horizontal plane.

10. A plank, comprising:

a first edge comprising a tongue and an adjacent first recess;

a second edge comprising a downwardly extending rib and an adjacent second recess, wherein said first and second edges are on opposite sides of said plank and comprise different mechanical interlocking structures; and a disengageable connector alternatively attachable to the first edge and the second edge, said connector comprising a bottom, a first arm, a second arm and a third arm, each arm extending from the bottom, the bottom comprising a flat bottom surface portion that lies on a first horizontal plane, the connector further having a groove between the second arm and the third arm and a rib-receiving portion between the first arm and the third arm, said groove configured to receive the tongue of the first edge for detachable connection thereto, and said rib-receiving portion configured to receive the downwardly extending rib of the second edge for detachable connection thereto, wherein the first arm extending upward from the bottom having first and second sidewalls extending vertically upward from the bottom, and a top planar surface extending between the first and second sidewalls, the second arm curving upwardly from the bottom surface portion of the connector and extending away from the third arm, and the third arm being located intermediate the first and second arms, said third arm extending upward from the bottom and including an initial upward extending portion and an integral horizontal extension extending toward a distal end of the second arm, wherein the horizontal extension having lower and upper planar sides.

11. The plank of claim 10, wherein:

the first arm configured to be received in the second recess of the plank, and the first and third arms at least partially defining a rib-receiving portion configured to receive the downwardly extending rib of the plank, for detachable connection to the second edge of the plank; and the second arm configured to be received in the first recess of the plank, the second and third arms defining a groove configured to receive the tongue of the plank, for detachable connection to the first edge of the plank.

12. The plank of claim 11, wherein, at the first edge, the tongue comprises a cantilevered tongue, and the first recess is located at a backside of the cantilevered tongue, wherein the first recess is configured to receive a distal end of said second arm.

13. The plank of claim 11, wherein the upper planar side being configured such that a bottom planar surface of a second edge of a plank is configured to rest thereon when the downwardly extending rib of the plank is received in the rib-receiving portion and the first arm is received in the second recess.

14. The plank of claim 13, wherein the second arm further comprising an upper multi-angled surface defining a groove bottom, wherein the multi-angled surface comprises a slanted bottom surface that is slanted with respect to the first horizontal plane and a wall extending diagonally upward with respect to the bottom surface portion, and wherein the groove has an access opening configured to allow the tongue of the first edge to enter the groove at a slanted angle relative to the horizontal extension and rotate after entry into said groove into mechanical interlock with the lower planar side of the horizontal extension of the third arm and the groove bottom defined by the upper multi-angled surface of the second arm.

15. The plank of claim 13, wherein said first arm and said third arm each further comprises a standoff latch configured to protrude into the rib-receiving portion to frictionally interfit with the downward extending rib when received in the rib-receiving portion.

16. The plank of claim 10, wherein the connector further comprising: said first arm configured to be received in the second recess of the plank, said second arm terminating in the distal end which is configured to be received in the first recess of the plank and having a multi-angled upper surface defining a groove bottom, wherein the multi-angled surface comprises a slanted bottom surface that is slanted with respect to the first horizontal plane and a wall extending diagonally upward with respect to the bottom surface portion, the third arm being located intermediate the first and second arms; a bottom planar surface of the second edge of the plank configured to rest on an upper planar side of the horizontal extension when the downwardly extending rib of the plank is received in the rib-receiving portion and the third arm is received in the second recess; and the groove is at least partially defined between the upper multi-angled surface of the second arm and the third arm, wherein the second and third arms define an access opening to the groove configured to allow the tongue of the first edge to enter the groove at a slanted angle relative to the horizontal extension and to rotate after entry into said groove into mechanical interlock with the lower planar side of the horizontal extension of the third arm and the upper multi-angled surface of the second arm.

17. The plank of claim 16, wherein the first arm further comprising a first arm latch and the third arm further comprising a third arm latch, wherein said first arm and third arm latches are configured to protrude into the rib-receiving portion so as to abut the downward extending rib when received in the rib-receiving portion.

18. The plank of claim 16, wherein the bottom of the connector comprises a nook that rises above the first plane.

19. The plank of claim 10, further comprising third and fourth edges extending between said first and second side edges, wherein said third edge comprising a profiled or straight edge, and the fourth edge comprising a profiled or straight edge, wherein said fourth edge is located opposite of said third edge.

20. The plank of claim 19, wherein the third and fourth edges extend between said first and second side edges, wherein said third and fourth side edges have complementary shapes configured for mechanical interconnection with different planks having similar edges as said third and fourth side edges.

21. The plank of claim 20, wherein the third edge having an extending shoulder, and the opposite fourth edge has an extending protruding lip, wherein the shoulder is adapted to be received in a protruding lip extending along a fourth edge of a similarly configured adjacent plank.

22. The plank of claim 20, wherein the third edge comprising a third edge groove and the fourth edge comprising a fourth edge tongue interfittable with third edge grooves in different planks having similar edges.

23. The plank of claim 20, wherein the plank has a first length measured parallel to the first and second edges and between the third and fourth edges and the connector has a second length substantially the same as the first length, wherein the tongue and adjacent first recess of the first edge, the downwardly extending rib and adjacent second recess of the second edge, extending along at least 90% of the first length, and the groove and rib-receiving portion of the connector extending along at least 90% of the second length.

24. The plank of claim 20, wherein the plank further comprises a panel member having generally planar top and bottom surfaces, and said first, second, third and fourth edges are defined in side edges extending between said top and bottom surfaces.

25. A surface-covering system comprising a plurality of planks according to claim 10.

26. A flooring system comprising a plurality of planks which are connected to each other in parallel rows along adjacent first and second side edges, and which are in contact with each other in parallel rows along an adjacent third and fourth end edges, said planks comprise a first mechanism for locking together said first and second side edges and a second mechanism to connect said third and fourth end edges; wherein said first mechanism comprises a first edge comprising a tongue and an adjacent first recess, a second edge comprising a downwardly extending rib and an adjacent second recess, wherein said first and second side edges are parallel to one another and comprise different mechanical interlocking structures, and a third end edge comprising a profiled or straight edge, a fourth end edge comprising a profiled or straight edge, wherein said third and fourth end edges are parallel to one another, and a connector joining a first side edge of a plank to a second side edge of an adjacent plank, said connector comprising a bottom, a first arm, a second arm and a third arm, each arm extending from the bottom, the bottom comprising a flat bottom surface portion that lies on a first horizontal plane, the connector further having a groove between the second arm and the third arm, the groove configured to receive the tongue of the first side edge of the plank and a rib-receiving portion between the first arm and the third arm, the rib-receiving portion configured to receive the downwardly extending rib of a second side edge of the adjacent plank, wherein the connector being detachable from said first and second side edges of the planks, the first arm extending upward from the bottom having first and second sidewalls extending vertically upward from the bottom, and a top planar surface extending between the first and second sidewalls, the second arm curving upwardly from the bottom surface portion of the connector and extending away from the third arm, and the third arm being located intermediate the first and second arms, said third arm extending upward from the bottom and including an initial upward extending portion and an integral horizontal extension extending toward a distal end of the second arm, wherein the horizontal extension having lower and upper planar sides.

27. The flooring system of claim 26, wherein:

the first arm configured to be received in the second recess of the adjacent second plank, and the first and third arms at least partially defining a rib-receiving portion configured to receive the downwardly extending rib of the second plank, for detachable connection to the second edge of the second plank; and the second arm configured to be received in the first recess of the first plank, the second and third arms defining a groove configured to receive the tongue of the first plank, for detachable connection to the first edge of the plank.

28. The flooring system of claim 27, wherein, at the first edge of the first plank, the tongue comprises a cantilevered tongue, and the first recess is located at a backside of the cantilevered tongue, wherein the first recess is configured to receive a distal end of said second arm.

29. The flooring system of claim 27, wherein the upper planar side being configured such that a bottom planar surface of the second edge of the second plank is configured to rest thereon when the downwardly extending rib of the second plank is received in the rib-receiving portion and the first arm is received in the second recess of the second plank.

30. The flooring system of claim 29, wherein the second arm further comprising an upper multi-angled surface defining a groove bottom, wherein the multi-angled surface comprises a slanted bottom surface that is slanted with respect to the first horizontal plane and a wall extending diagonally upward with respect to the bottom surface portion, and wherein the groove has an access opening configured to allow the tongue of the first edge of the first plank to enter the groove at a slanted angle relative to the horizontal extension and rotate after entry into said groove into mechanical interlock with the lower planar side of the horizontal extension of the third arm and the groove bottom defined by the upper multi-angled surface of the second arm.

31. The flooring system of claim 29, wherein said first arm and said third arm each further comprises a standoff latch configured to protrude into the rib-receiving portion to frictionally interfit with the downward extending rib of the second plank when received in the rib-receiving portion.

32. The flooring system of claim 26, wherein a plank further comprise a panel member having generally planar top and bottom surfaces, and said first, second, third and fourth edges are defined in side edges extending between said top and bottom surfaces.

33. A disengageable connector for assembling floor planks of a flooring system, comprising:

a bottom comprising a flat bottom surface portion that lies on a first horizontal plane;

first, second and third arms, wherein the first arm extending upward from the bottom, said first arm configured to be received in a recess of an adjacent plank wherein the first arm comprises first and second sidewalls extending vertically upward from the bottom, and a top planar surface extending between the first and second sidewalls, the second arm curving upwardly from the bottom surface portion and said second arm extending away from the third arm, said second arm terminating in a distal end configured to be received in a recess of a plank, the third arm being located intermediate the first and second arms, said third arm extending upward from the bottom and including an initial upward extending portion and an integral horizontal extension extending toward the distal end of the second arm, wherein the horizontal extension having lower and upper planar sides; a rib-receiving portion at least partially defined between the first arm and the third arm; and a tongue-receiving groove at least partially defined between the second arm and the third arm, wherein said connector being alternatively attachable to a first edge and a second edge of a plank, wherein said first edge of said plank having a tongue which is receivable in said tongue-receiving groove and said second edge of said plank having a downwardly-extending rib which is receivable in said rib-receiving portion, wherein said first and second edges are on opposite sides of said plank and comprise different mechanical interlocking structures.

34. The disengageable connector of claim 33, wherein the second arm having a multi-angled upper surface defining a groove bottom.

35. The disengageable connector of claim 34, wherein the multi-angled surface comprises a slanted bottom surface that is slanted with respect to the first horizontal plane and a wall extending diagonally upward with respect to the bottom surface portion.

36. A flooring system comprising a plurality of planks which are connected to each other in parallel rows along an adjacent first edge and an adjacent second edge, and which are in contact with each other in parallel rows along an adjacent third edge and an adjacent fourth edge, said planks comprise a first mechanism for locking together said first and second edges and a second mechanism to connect said third and fourth edges; wherein said first mechanism comprises first and second grooved edges connected by inserting a co-extruded barbed spline jointly into adjacent grooves defined in adjacent first and second edges, and said third edge having a tongue and said fourth edge having a downwardly-extending rib, wherein said third and fourth edges comprise different mechanical interlocking structures, and wherein said second mechanism comprising a disengageable connector alternatively attachable to the third edge and the fourth edge, said disengageable connector comprising a bottom, a first arm, a second arm and a third arm, each arm extending from the bottom, the bottom comprising a flat bottom surface portion that lies on a first horizontal plane, the connector further having a groove between the second arm and the third arm and a rib-receiving portion between the first arm and the third arm, wherein said groove is configured to receive the tongue of the third edge for detachable connection thereto, and said rib-receiving portion is configured to receive the downwardly extending rib of the fourth edge for detachable connection thereto, the first arm extending upward from the bottom having first and second sidewalls extending vertically upward from the bottom, and a top planar surface extending between the first and second sidewalls, the second arm curving upwardly from the bottom surface portion of the connector and extending away from the third arm, and the third arm being located intermediate the first and second arms, said third arm extending upward from the bottom and including an initial upward extending portion and an integral horizontal extension extending toward a distal end of the second arm, wherein the horizontal extension having lower and upper planar sides.

37. A method for joining floor planks into a surface covering, comprising:

providing a first and second plank, wherein each plank comprises a first edge comprising a tongue and an adjacent first recess, a second edge comprising a downwardly extending rib and an adjacent second recess, wherein said first and second edges are on opposite sides of the planks and comprise different mechanical interlocking structures, a third edge comprising a profiled or straight edge, and a fourth edge comprising a profiled or straight edge, wherein said fourth edge is located opposite of said third edge, and at least one connector alternatively attachable to the first edge and the second edge of the planks, wherein the connector comprises a bottom, a first arm, a second arm and a third arm, each arm extending from the bottom, the bottom comprising a flat bottom surface portion that lies on a first horizontal plane, the connector further having a groove between the second arm and the third arm and a rib-receiving portion between the first arm and the third arm, said groove configured to receive the tongue of the first edge of one of the planks for detachable connection thereto, and said rib-receiving portion configured to receive the downwardly extending rib of the second edge of one of the planks for detachable connection thereto, the first arm extending upward from the bottom having first and second sidewalls extending vertically upward from the bottom, and a top planar surface extending between the first and second sidewalls, the second arm curving upwardly from the bottom surface portion of the connector and extending away from the third arm, and the third arm being located intermediate the first and second arms, said third arm extending upward from the bottom and including an initial upward extending portion and an integral horizontal extension extending toward a distal end of the second arm, wherein the horizontal extension having lower and upper planar sides;

inserting one of the downwardly-extending ribs of one of the edges of the first plank into the rib-receiving portion of one of the connectors;

inserting one of the tongues located along one of the edges of the second plank at a slanted angle into the groove of the connector; and rotating the first and second planks relative to each other to lock the tongue in place relative to the groove to form a mechanical interlock therewith as the planks are brought into substantially co-planar orientation; and moving a third plank toward the first or second plank in a direction substantially perpendicular to the first edge of the first plank and substantially perpendicular to the second edge of the second plank wherein a third edge of the third plank is engaged with a fourth edge of the first or second plank panel wherein the first, second, and third planks are substantially coplanar.

38. The method of claim 37, further comprising:

inserting a leading connector arm comprising the first arm in a recess defined in the rib-profiled side edge of the first plank in combination with the rib being received by the rib-receiving portion of the connector, wherein an overlying portion of the rib-profiled side edge comes to rest on a horizontal-extending portion of an intermediate connector arm comprising the third arm, which together with a separate trailing connector arm comprising the second arm defines the groove, and inserting the trailing connector arm in a separate recess defined in the tongue-side edge of the adjacent second plank in combination with the tongue rotating into locked position within the groove.

* * * * *